US012768560B2

(12) United States Patent
Oh et al.

(10) Patent No.: US 12,768,560 B2
(45) Date of Patent: Oct. 20, 2026

(54) AIR CONDITIONER AND CONTROL METHOD THEREOF

(71) Applicant: Samsung Electronics Co., Ltd., Suwon-si (KR)

(72) Inventors: Seungwon Oh, Suwon-si (KR); Sungjae Kim, Suwon-si (KR); Younghoon Kim, Suwon-si (KR); Sunhee Son, Suwon-si (KR); Moonsun Shin, Suwon-si (KR); Jongkweon Ha, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 109 days.

(21) Appl. No.: 18/988,034

(22) Filed: Dec. 19, 2024

(65) Prior Publication Data

US 2025/0216113 A1 Jul. 3, 2025

Related U.S. Application Data

(63) Continuation of application No. PCT/KR2024/096573, filed on Nov. 15, 2024.

(30) Foreign Application Priority Data

Dec. 28, 2023 (KR) ..... 10-2023-0195404

(51) Int. Cl.
*F24F 11/83* (2018.01)

(52) U.S. Cl.
CPC ..... *F24F 11/83* (2018.01)

(58) Field of Classification Search
CPC .... F24F 11/83; F24F 1/039; F24F 1/42; F24F 2013/225
See application file for complete search history.

(56) References Cited

FOREIGN PATENT DOCUMENTS

| | | | |
|---|---|---|---|
| CN | 209166221 | U | 7/2019 |
| CN | 111811106 | A | 10/2020 |
| CN | 110410925 | B | 12/2021 |
| CN | 114183888 | A | 3/2022 |
| CN | 217876234 | | 11/2022 |
| JP | H0651730 | U | 7/1994 |
| JP | 6213475 | | 8/1994 |

(Continued)

OTHER PUBLICATIONS

Machine English language translation of KR102186677 to Hong et al. Translated May 2026 (Year: 2018).*

(Continued)

*Primary Examiner* — Cassey D Bauer
(74) *Attorney, Agent, or Firm* — Nixon & Vanderhye, P.C.

(57) ABSTRACT

An air conditioner comprises: an evaporator; a condenser; a base disposed under the evaporator; a scattering wheel configured to scatter water stored in the base toward the condenser; a wheel motor configured to rotate the scattering wheel; an outdoor fan configured to blow outdoor air into the condenser; a fan motor configured to rotate the outdoor fan; a water level sensor configured to detect a water level of the water stored in the base; and a controller, comprising processing circuitry, individually and/or collectively, configured to rotate the wheel motor and the fan motor based on termination of an operation of the air conditioner and a detection result of the water level sensor.

15 Claims, 17 Drawing Sheets

(56) References Cited

FOREIGN PATENT DOCUMENTS

| | | | |
|---|---|---|---|
| JP | 10-160197 | | 6/1998 |
| JP | 7182922 | B2 | 11/2022 |
| KR | 10-2008-0043550 | | 5/2008 |
| KR | 101858812 | B1 | 5/2018 |
| KR | 10-2019-0083888 | | 7/2019 |
| KR | 102186677 | B1 | 12/2020 |
| KR | 102296329 | B1 | 9/2021 |
| KR | 10-2023-0083445 | | 6/2023 |
| KR | 10-2541595 | | 6/2023 |

OTHER PUBLICATIONS

Samsung Air Conditioner AW06C7155WWA Information and manual, 93 pages, Apr. 29, 2023.
Search Report and Written Opinion dated Mar. 6, 2025 issued in International Patent Application No. PCT/KR2024/096573.

* cited by examiner

FIG. 16

| WEATHER | HUMIDITY | CLEANLINESS | OPERATION MODE |
|---|---|---|---|
| CLEAR | 60% OR MORE | GOOD | OFF |
| | | NORMAL | ROATE FAN MOTOR AT FIRST SPEED (10 MIN.) |
| | | BAD | ROTATE FAN MOTOR AT SECOND SPEED (15 MIN.) |
| | | VERY BAD | ROTATE FAN MOTOR AT MAXIMUM SPEED (20 MIN.) |
| | LESS THAN 60% | GOOD | OFF |
| | | NORMAL | OFF |
| | | BAD | ROTATE FAN MOTOR AT FIRST SPEED (10 MIN.) |
| | | VERY BAD | ROTATE FAN MOTOR AT SECOND SPEED (15 MIN.) |
| RAIN | IRRELEVANCE | GOOD | ROTATE FAN MOTOR AT FIRST SPEED (10 MIN.) |
| | | NORMAL | |
| | | BAD | ROTATE WHEEL MOTOR AND ROTATE FAN MOTOR AT MAXIMUM SPEED (20 MIN.) |
| | | VERY BAD | |

AIR CONDITIONER AND CONTROL METHOD THEREOF

CROSS-REFERENCE TO RELATED APPLICATIONS

This application is a continuation of International Application No. PCT/KR2024/096573 designating the United States, filed on Nov. 15, 2024, in the Korean Intellectual Property Receiving Office and claiming priority to Korean Patent Application No. 10-2023-0195404, filed on Dec. 28, 2023, in the Korean Intellectual Property Office, the disclosures of each of which are incorporated by reference herein in their entireties.

BACKGROUND

Field

The present disclosure relates to an air conditioner and a control method thereof, and for example, to an air conditioner including an improved structure and a control method thereof.

Description of Related Art

An air conditioner is a device that performs functions such as air purification, ventilation, humidity control, cooling, or heating in an air conditioning space, and refers to a device equipped with at least one of these functions.

The air conditioner may cool or heat a space using a refrigeration cycle. The air conditioner may include a compressor, a condenser, an expansion device, an evaporator, and a pipe. A refrigerant may circulate along the pipes through the compressor, the condenser, the expansion device, and the evaporator.

The air conditioners may be classified into a separate air conditioner and an integrated air conditioner. The separate air conditioner may include an indoor unit disposed indoors and an outdoor unit disposed outdoors. In the integrated air conditioner, both an indoor unit and an outdoor unit may be disposed in a single housing.

As for the integrated air conditioner, due to the structural feature that both the indoor and outdoor units are disposed in one housing, condensed water or rainwater flowing from the outside may be stored in a lower base. In addition, a condenser, which is exposed to the outdoor environment, may be exposed to contamination, and particularly, foreign substances may accumulate on the condenser.

SUMMARY

Embodiments of the disclosure provide an air conditioner capable of removing water stored in a base so as to prevent and/or reduce contamination that may result therefrom, and a control method thereof.

Embodiments of the disclosure provide an air conditioner capable of preventing and/or reducing contamination and malfunction of a condenser by removing foreign substances accumulating in the condenser, and a control method thereof.

Embodiments of the disclosure provide an air conditioner capable of, when water in a base is full due to rain or other reasons, driving a wheel motor and a fan motor to remove the stored water and remove foreign substances from a condenser, and a control method thereof.

Embodiments of the disclosure provide an air conditioner capable of appropriately removing stored water and foreign substances according to external environmental information, and a control method thereof.

Embodiments of the disclosure provide an air conditioner capable of improving foreign substance reduction performance of a condenser by detecting absence of a user and rotating a fan motor at a maximum speed accordingly, and a control method thereof.

An example embodiment of the present disclosure provides an air conditioner including: an evaporator; a condenser; a base disposed under the evaporator; a scattering wheel configured to scatter water stored in the base toward the condenser; a wheel motor configured to rotate the scattering wheel; an outdoor fan configured to blow outdoor air into the condenser; a fan motor configured to rotate the outdoor fan; a water level sensor configured to detect a water level of the water stored in the base; and a controller including at least one processor, comprising processing circuitry, individually and/or collectively, configured to rotate the wheel motor and the fan motor based on termination of an operation of the air conditioner and a detection result of the water level sensor.

An example embodiment of the present disclosure provides a method of controlling an air conditioner including an evaporator; a condenser; a base disposed under the evaporator; a scattering wheel configured to scatter water stored in the base toward the condenser; a wheel motor configured to rotate the scattering wheel; an outdoor fan configured to blow outdoor air into the condenser; and a fan motor configured to rotate the outdoor fan, the method including: receiving a command to terminate an operation of the air conditioner; detecting a water level of water stored in the base; and rotating the wheel motor and the fan motor based on a detection result.

BRIEF DESCRIPTION OF THE DRAWINGS

The above and other aspects, features and advantages of certain embodiments of the present disclosure will be more apparent from the following detailed description, taken in conjunction with the accompanying drawings, in which:

FIG. 16 is a table illustrating example control according to various external environment information according to various embodiments.

DETAILED DESCRIPTION

Figure 1:
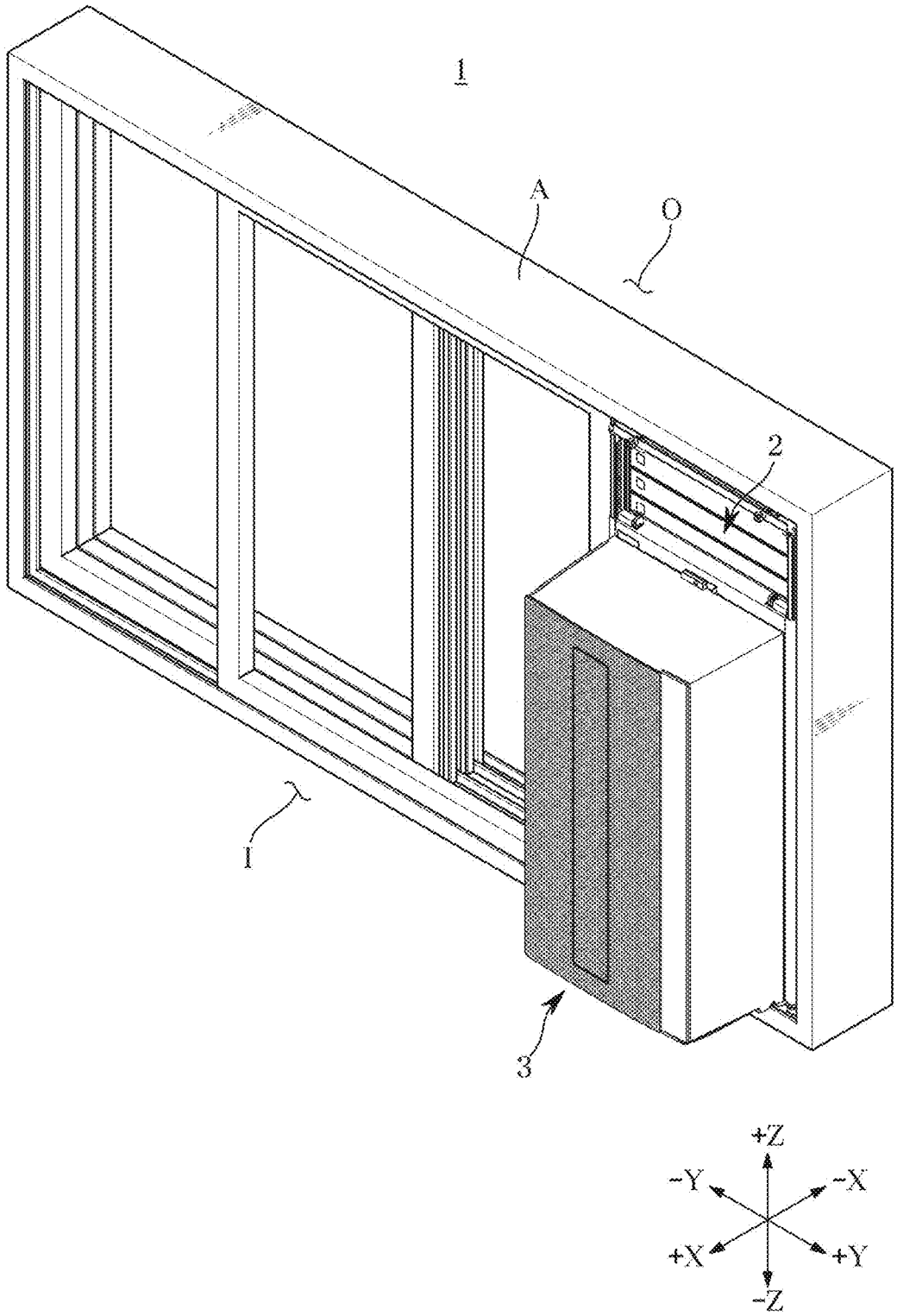
FIG. 1 is a perspective view illustrating an air conditioning system according to various embodiments.

Various embodiments of the disclosure and terms used herein are not intended to limit the technical features described herein to specific embodiments, and should be understood to include various modifications, equivalents, or substitutions of the corresponding embodiments.

In describing of the drawings, similar reference numerals may be used for similar or related elements.

The singular form of a noun corresponding to an item may include one or more of the items unless clearly indicated otherwise in a related context.

In the disclosure, phrases, such as "A or B", "at least one of A and B", "at least one of A or B", "A, B or C", "at least one of A, B and C", and "at least one of A, B, or C" may include any one or all possible combinations of the items listed together in the corresponding phrase among the phrases.

As used herein, the term "and/or" includes any and all combinations of one or more of the associated listed items.

Terms such as "1st", "2nd", "primary", or "secondary" may be used simply to distinguish an element from other elements, without limiting the element in other aspects (e.g., importance or order).

When an element (e.g., a first element) is referred to as being "(functionally or communicatively) coupled" or "connected" to another element (e.g., a second element), the first element may be connected to the second element, directly (e.g., wired), wirelessly, or through a third element.

It will be understood that when the terms "includes", "comprises", "including", and/or "comprising" are used in the disclosure, they specify the presence of the specified features, figures, steps, operations, components, members, or combinations thereof, but do not preclude the presence or addition of one or more other features, figures, steps, operations, components, members, or combinations thereof.

When a given element is referred to as being "connected to", "coupled to", "supported by" or "in contact with" another element, it is to be understood that it may be directly or indirectly connected to, coupled to, supported by, or in contact with the other element. When a given element is indirectly connected to, coupled to, supported by, or in contact with another element, it is to be understood that it may be connected to, coupled to, supported by, or in contact with the other element through a third element.

It will also be understood that when an element is referred to as being "on" another element, it may be directly on the other element or intervening elements may also be present.

An air conditioner according to various embodiments may refer to a device that performs functions such as purification, ventilation, humidity control, cooling or heating in an air conditioning space (hereinafter referred to as "indoor space"), and in particular a device having at least one of these functions.

According to an embodiment, an air conditioner may include a heat pump device to perform a cooling function or a heating function. The heat pump device may include a refrigeration cycle in which a refrigerant is circulated through a compressor, a first heat exchanger, and an expansion device and a second heat exchanger. All of the components of the heat pump device may be embedded in a single housing forming an exterior of an air conditioner, which includes a window-type air conditioner or a portable air conditioner. On the other hand, some components of the heat pump device may be divided and embedded in a plurality of housings forming a single air conditioner, which includes a wall-mounted air conditioner, a stand-type air conditioner, and a system air conditioner.

The air conditioner including the plurality of housings may include at least one outdoor unit installed outdoors and at least one indoor unit installed indoors. For example, the air conditioner may be provided such that a single outdoor unit and a single indoor unit are connected by a refrigerant pipe. Alternatively, the air conditioner may be provided such that a single outdoor unit is connected to two or more indoor units by a refrigerant pipe. Alternatively, the air conditioner may be provided such that two or more outdoor units and two or more indoor units are connected by a plurality of refrigerant pipes.

The outdoor unit may be electrically connected to the indoor unit. For example, information (or commands) for controlling the air conditioner may be received through an input interface provided in the outdoor unit or the indoor unit. The outdoor unit and the indoor unit may operate simultaneously or sequentially in response to a user input.

The air conditioner may include an outdoor heat exchanger provided in the outdoor unit, an indoor heat exchanger provided in the indoor unit, and a refrigerant pipe connecting the outdoor heat exchanger and the indoor heat exchanger.

The outdoor heat exchanger may be configured to exchange heat between a refrigerant and air from outdoor through a phase change of the refrigerant (e.g., evaporation or condensation). For example, while the refrigerant is condensed in the outdoor heat exchanger, the refrigerant may radiate heat to the outdoor air. While the refrigerant flowing in the outdoor heat exchanger evaporates, the refrigerant may absorb heat from the outdoor air.

The indoor unit is installed indoors. For example, according to the arrangement method of the indoor unit, the air conditioner may be classified into a ceiling-type indoor unit, a stand-type indoor unit, a wall-type indoor unit, and the like. For example, the ceiling-type indoor unit may be classified into a 4-way type indoor unit, a 1-way type indoor unit, a duct type indoor unit and the like according to a method of discharging air.

Similarly, the indoor heat exchanger may be configured to exchange heat between a refrigerant and outdoor air through a phase change of the refrigerant (e.g., evaporation or condensation). For example, while the refrigerant evaporates in the indoor unit, the refrigerant may absorb heat from the indoor air. The indoor space may be cooled by blowing the indoor air cooled through the cooled indoor heat exchanger. While the refrigerant is condensed in the indoor heat exchanger, the refrigerant may radiate heat to the indoor air. The indoor space may be heated by blowing the indoor air heated through the high-temperature indoor heat exchanger.

In other words, the air conditioner may perform a cooling or heating function by a phase change process of a refrigerant circulated between the outdoor heat exchanger and the indoor heat exchanger. To circulate the refrigerant, the air conditioner may include a compressor to compress the refrigerant. The compressor may draw refrigerant gas through an inlet and compress the refrigerant gas. The compressor may discharge high-temperature and high-pressure refrigerant gas through an outlet. The compressor may be disposed inside the outdoor unit.

Through the refrigerant pipe, the refrigerant may be circulated sequentially through the compressor, the outdoor heat exchanger, the expansion device, and the indoor heat exchanger or sequentially circulated through the compressor, the indoor heat exchanger, the expansion device, and the outdoor heat exchanger.

For example, in the air conditioner, when a single outdoor unit and a single indoor unit are directly connected through a refrigerant pipe, the refrigerant may be circulated between the single outdoor unit and the single indoor unit through the refrigerant pipe.

For example, in the air conditioner, when a single outdoor unit is connected to two or more indoor units through a refrigerant pipe, the refrigerant may flow from the single outdoor unit to the plurality of indoor units through branched refrigerant pipes. Refrigerant discharged from the plurality of indoor units may be combined and circulated to the outdoor unit. For example, each of the plurality of indoor units may be directly connected in parallel to the single outdoor unit through a separate refrigerant pipe.

Each of the plurality of indoor units may be operated independently according to an operation mode set by a user. In other words, some of the plurality of indoor units may be operated in a cooling mode while others of the plurality of indoor units are operated in a heating mode. At that time, the refrigerant may be selectively introduced into each indoor unit in a high-pressure state or a low-pressure state, discharged, and circulated to the outdoor unit along a circulation path that is designated through a flow path switching valve to be described in greater detail below.

For example, in the air conditioner, when two or more outdoor units and two or more indoor units are connected by the plurality of refrigerant pipes, refrigerant discharged from the plurality of outdoor units may be combined and flow through one refrigerant pipe, and then diverged again at a certain point and introduced into the plurality of indoor units.

All of the plurality of outdoor units may be driven or at least some of the plurality of outdoor units may not be driven, in accordance with to a driving load corresponding to an operating amount of the plurality of indoor units. At that time, the refrigerant may be provided through a flow path switching valve to be introduced into and circulated to an outdoor unit that is selectively driven. The air conditioner may include the expansion device to reduce the pressure of the refrigerant flowing into the heat exchanger. For example, the expansion device may be disposed inside the indoor unit or inside the outdoor unit, or disposed both inside the indoor unit and the outdoor unit.

The expansion device may reduce the temperature and pressure of the refrigerant using a throttling effect. The expansion device may include an orifice configured to reduce a cross-sectional area of a flow path. A temperature and pressure of the refrigerant passing through the orifice may be lowered.

For example, the expansion device may be implemented as an electronic expansion valve configured to adjust an opening ratio (a ratio of a cross-sectional area of a flow path of a valve in a partially opened state to a cross-sectional area of the flow path of the valve in a fully opened state). According to the opening ratio of the electronic expansion valve, the amount of refrigerant passing through the expansion device may be adjusted.

The air conditioner may further include a flow path switching valve disposed on the refrigerant circulation path. The flow path switching valve may include a 4-way valve. The flow path switching valve may determine a refrigerant circulation path depending on an operation mode of the indoor unit (e.g., cooling operation or heating operation). The flow path switching valve may be connected to the outlet of the compressor.

The air conditioner may include an accumulator. The accumulator may be connected to the inlet of the compressor. A low-temperature and low-pressure refrigerant, which is evaporated in the indoor heat exchanger or the outdoor heat exchanger, may flow into the accumulator.

When a refrigerant mixture of refrigerant liquid and refrigerant gas is introduced, the accumulator may separate the refrigerant liquid from the refrigerant gas, and supply the refrigerant gas separated from the refrigerant liquid to the compressor.

An outdoor fan may be installed near the outdoor heat exchanger. The outdoor fan may blow outdoor air to the outdoor heat exchanger to promote heat exchange between the refrigerant and the outdoor air.

The outdoor unit of the air conditioner may include at least one sensor. For example, the outdoor unit sensor may be provided as an environmental sensor. The outdoor unit sensor may be disposed at a given position of the inside or the outside of the outdoor unit. For example, the outdoor unit sensor may include a temperature sensor configured to detect an air temperature around the outdoor unit, an air humidity sensor configured to detect air humidity around the outdoor unit, or a refrigerant temperature sensor configured to detect a refrigerant temperature in a refrigerant pipe passing through the outdoor unit, or a refrigerant pressure sensor configured to detect a refrigerant pressure in a refrigerant pipe passing through the outdoor unit.

The outdoor unit of the air conditioner may include an outdoor unit communication circuitry. The outdoor unit communication circuitry may be configured to receive a control signal from an indoor unit controller of the air conditioner, which will be described in greater detail below. Based on a control signal received through the outdoor unit communication circuitry, the outdoor unit may control the operation of the compressor, the outdoor heat exchanger, the expansion device, the flow path switching valve, the accumulator, or the outdoor fan. The outdoor unit may transmit a measurement value detected by the outdoor unit sensor to the indoor unit controller through the outdoor unit communication circuitry.

The indoor unit of the air conditioner may include a housing, a blower configured to circulate air inside or outside the housing, and the indoor heat exchanger configured to exchange heat with air introduced into the housing.

The housing may include an inlet. Indoor air may flow into the housing through the inlet.

The indoor unit of the air conditioner may include a filter configured to filter out foreign substance in air that is introduced into the inside of the housing through the inlet.

The housing may include an outlet. Air flowing inside the housing may be discharged to the outside of the housing through the outlet.

An airflow guide configured to guide a direction of air discharged through the outlet may be provided in the housing of the indoor unit. For example, the airflow guide may include a blade positioned in the outlet. For example, the airflow guide may include an auxiliary fan for regulating an exhaust airflow, but is not limited thereto. Alternatively, the airflow guide may be omitted.

The indoor heat exchanger and the blower arranged on a flow path connecting the inlet and the outlet may be disposed inside the housing of the indoor unit.

The blower may include an indoor fan and a fan motor. For example, the indoor fan may include an axial fan, a mixed-flow fan, a cross-flow fan and a centrifugal fan.

The indoor heat exchanger may be arranged between the blower and the outlet or between the inlet and the blower. The indoor heat exchanger may absorb heat from air introduced through the inlet or transfer heat to air introduced through the inlet. The indoor heat exchanger may include a heat exchange tube through which refrigerant flows, and heat exchange fins in contact with the heat exchange tube to increase a heat transfer area.

The indoor unit of the air conditioner may include a drain tray disposed below the indoor heat exchanger to collect condensed water generated in the indoor heat exchanger. The condensed water contained in the drain tray may be drained to the outside through a drain hose. The drain tray may be arranged to support the indoor heat exchanger.

The indoor unit of the air conditioner may include an input interface. The input interface may include any type of user input means including a button, a switch, a touch screen and/or a touch pad. A user can directly input setting data (e.g., desired indoor temperature, cooling/heating/dehumidifying/air cleaning operation mode setting, outlet selection setting, and/or air volume setting) through the input interface.

The input interface may be connected to an external input device. For example, the input interface may be electrically connected to a wired remote controller. The wired remote controller may be installed at a specific location (e.g., a part of a wall) in an indoor space. A user may input setting data related to the operation of the air conditioner by manipulating the wired remote controller. An electrical signal corresponding to the setting data obtained by the wired remote controller may be transmitted to the input interface. In addition, the input interface may include an infrared sensor. A user may remotely input the setting data for operating the air conditioner using a wireless remote controller. The setting data received by the wireless remote controller may be transmitted to the input interface as an infrared signal.

In addition, the input interface may include a microphone. A user's voice command may be obtained through the microphone. The microphone may convert a user's voice command into an electrical signal and transmit the converted electrical signal to the indoor unit controller. The indoor unit controller may control components of the air conditioner to perform a function corresponding to the user's voice command. The setting data obtained through the input interface (e.g., desired indoor temperature, cooling/heating/dehumidifying/air cleaning operation mode setting, outlet selection setting, and/or air volume setting) may be transmitted to the indoor unit controller to be described in greater detail below. For example, the setting data obtained through the input interface may be transmitted to the outside, for example, to the outdoor unit or a server through an indoor unit communication circuitry to be described in greater detail below.

The indoor unit of the air conditioner may include a power module. The power module may be connected to an external power source to supply power to components of the indoor unit.

The indoor unit of the air conditioner may include an indoor unit sensor. The indoor unit sensor may be an environmental sensor disposed inside or outside the housing. For example, the indoor unit sensor may include one or more temperature sensors and/or humidity sensors disposed in a predetermined space inside or outside the housing of the indoor unit. For example, the indoor unit sensor may include a refrigerant temperature sensor configured to detect a refrigerant temperature of a refrigerant pipe passing through the indoor unit. For example, the indoor unit sensor may include a refrigerant temperature sensor each configured to detect a temperature of an entrance, a middle portion and/or an exit of the refrigerant pipe passing through the indoor heat exchanger.

For example, each environmental information detected by the indoor unit sensor may be transmitted to the indoor unit controller to be described in greater detail below or transmitted to the outside through the indoor unit communication circuitry to be described in greater detail below.

The indoor unit of the air conditioner may include the indoor unit communication circuitry. The indoor unit communication circuitry may include at least one of a short-range wireless communication module and a long-range wireless communication module. The indoor unit communication circuitry may include at least one antenna for wirelessly communicating with other devices. The outdoor unit may include the outdoor unit communication circuitry. The outdoor unit communication circuitry may also include at least one of a short-range wireless communication module and a long-range wireless communication module.

The short-range wireless communication module may include a Bluetooth communication module, a Bluetooth Low Energy (BLE) communication module, a near field communication module, a WLAN (Wi-Fi) communication module, and a Zigbee communication module, an infrared data association (IrDA) communication module, a Wi-Fi Direct (WFD) communication module, an ultrawideband (UWB) communication module, an Ant+ communication module, a microwave (uWave) communication module, etc., but is not limited thereto.

The long-range wireless communication module may include a communication module that performs various types of long-range wireless communication, and may include a mobile communication circuitry. The mobile communication circuitry transmits and receives radio signals with at least one of a base station, an external terminal, and a server in a mobile communication network.

The indoor unit communication circuitry may communicate with an external device such as a server, a mobile device and other home appliances through an access point (AP). The AP may connect a local area network (LAN), to which an air conditioner or a user device is connected, to a wide area network (WAN) to which a server is connected. The air conditioner or the user device may be connected to the server through the WAN. The indoor unit of the air conditioner may include the indoor unit controller configured to control components of the indoor unit including the blower.

The outdoor unit of the air conditioner may include an outdoor unit controller configured to control components of the outdoor unit including the compressor. The indoor unit controller may communicate with the outdoor unit controller through the indoor unit communication circuitry and the outdoor unit communication circuitry. The outdoor unit communication circuitry may transmit a control signal generated by the outdoor unit controller to the indoor unit communication circuitry, or transmit a control signal, which is transmitted from the indoor unit communication circuitry, to the outdoor unit controller. In other words, the outdoor unit and the indoor unit may perform bi-directional communication. The outdoor unit and the indoor unit may transmit and receive various signals generated during the operation of the air conditioner.

The outdoor unit controller may be electrically connected to components of the outdoor unit and may control the operation of each component. For example, the outdoor unit controller may adjust a frequency of the compressor and control the flow path switching valve to change a circulation direction of the refrigerant. The outdoor unit controller may adjust a rotational speed of the outdoor fan. In addition, the outdoor unit controller may generate a control signal to adjust the opening degree of the expansion valve. Under the control of the outdoor unit controller, the refrigerant may be circulated along the refrigerant circulation circuit including the compressor, the flow path switching valve, the outdoor heat exchanger, the expansion valve, and the indoor heat exchanger.

Various temperature sensors included in the outdoor unit and the indoor unit may transmit electrical signals corresponding to detected temperatures to the outdoor unit controller and/or the indoor unit controller. For example, the humidity sensors included in the outdoor unit and the indoor unit may respectively transmit electrical signals corresponding to the detected humidity to the outdoor unit controller and/or the indoor unit controller.

The indoor unit controller may obtain a user input from a user device including a mobile device through the indoor unit communication circuitry, or directly obtain a user input through the input interface or the remote controller. The indoor unit controller may control components of the indoor unit including the blower in response to the received user input. The indoor unit controller may transmit information related to the received user input to the outdoor unit controller of the outdoor unit.

The outdoor unit controller may control components of the outdoor unit including the compressor based on the information related to the user input received from the indoor unit. For example, when a control signal corresponding to a user input for selecting an operation mode such as a cooling operation, a heating operation, a fan operation, a defrosting operation, or a dehumidifying operation is received from the indoor unit, the outdoor unit controller may control components of the outdoor unit to perform an operation of the air conditioner corresponding to the selected operation mode.

The outdoor unit controller and the indoor unit controller may include a processor and a memory, respectively. The indoor unit controller may include at least one a first processor and at least one a first memory, and the outdoor unit controller may include at least one a second processor and at least one a second memory.

The memory may record/store various types of information necessary for the operation of the air conditioner. The memory may store instructions, applications, data and/or programs necessary for the operation of the air conditioner. For example, the memory may store various programs for the cooling operation, the heating operation, the dehumidifying operation, and/or the defrosting operation of the air conditioner. The memory may include volatile memory, such as a static random access memory (S-RAM) and a dynamic random access memory (D-RAM) for temporarily storing data. In addition, the memory may include a non-volatile memory, such as a read only memory (ROM), an erasable programmable read only memory (EPROM), and an electrically erasable programmable read only memory (EEPROM) for long-term storage of data.

The processor may generate a control signal for controlling an operation of the air conditioner based on instructions, applications, data, and/or programs stored in the memory. The processor may be hardware and may include a logic circuit and an arithmetic circuit. The processor may process data according to a program and/or instructions provided from the memory, and may generate a control signal according to a processing result. The memory and the processor may be implemented as one control circuit or as a plurality of circuits.

The indoor unit of the air conditioner may include an output interface. The output interface may be electrically connected to the indoor unit controller, and output information related to the operation of the air conditioner under the control of the indoor unit controller. For example, the output interface may output information, such as an operation mode selected by a user input, a wind direction, a wind volume, and a temperature. In addition, the output interface may output sensing information obtained from the indoor unit sensor or the outdoor unit sensor, and output warning/error messages.

The output interface may include a display and a speaker. The speaker may be a sound device and configured to output various sounds. The display may display information, which is input by a user or provided to a user, as various graphic elements. For example, operational information of the air conditioner may be displayed as at least one of an image and text. In addition, the display may include an indicator that provides specific information. The display may include a liquid crystal display (LCD) panel, a light emitting diode (LED) panel, an organic light emitting diode (OLED) panel, a micro-LED panel, and/or a plurality of LEDs.

The present disclosure will be described in greater detail below with reference to the accompanying drawings.

Hereinafter for convenience of description, a window-type air conditioner installed on a window and/or a window frame will be described as an example. However, contents of the present disclosure may also be applied to other types of air conditioners. For example, contents of the present disclosure may also be applied to portable air conditioners, wall-mounted air conditioners, ceiling-type air conditioners, and floor-type air conditioners.

In the following detailed description, the terms of "upward", "downward", "forward", "rearward" and the like may be defined by drawings, but the shape and the location of the component is not limited by the term. For example, referring to FIG. 1, when an air conditioner 3 according to an embodiment of the present disclosure is mounted on a mounting assembly 2, a direction in which the air conditioner 3 faces an indoor space I may be defined as forward (+X direction), and a direction in which the air conditioner 3 faces an outdoor space O may be defined as rearward (−X direction). Further, when the air conditioner 3 is mounted on the mounting assembly 2, a direction in which the air conditioner 3 faces vertically upward may be defined as upward (+Z direction), and, a direction in which the air conditioner 3 faces vertically downward may be defined as downward (−Z direction). Further, when the air conditioner 3 is mounted on the mounting assembly 2, directions parallel to +Y direction and −Y direction may be defined as left and right directions based on the drawing.

FIG. 1 is a perspective view illustrating an air conditioning system according to various embodiments.

Referring to FIG. 1, an air conditioning system 1 according to an embodiment of the present disclosure may include the mounting assembly 2.

The mounting assembly 2 may be provided to mount the air conditioner 3, which will be described in greater detail below. The mounting assembly 2 may allow the air conditioner 3 to be mounted on a structure A.

The mounting assembly 2 may be provided to be installable on the structure A. The mounting assembly 2 may be provided to be mountable on the structure A. The mounting assembly 2 may be provided to be fixable to the structure A.

The mounting assembly 2 may be provided to seal between the air conditioner 3 and the structure A. The mounting assembly 2 may be provided to seal between an indoor space I and an outdoor space O.

For example, the structure A may include a window and/or a window frame. However, the present disclosure is not limited thereto. The structure A may be provided in various ways according to the type of air conditioner 3. For example, the structure A may include at least one of a wall, a ceiling, or a floor.

The air conditioning system 1 according to an embodiment of the present disclosure may include the air conditioner 3.

The air conditioner 3 may be provided to be mounted on the mounting assembly 2. The air conditioner 3 may be provided to be mounted on the structure A by being mounted on the mounting assembly 2. The air conditioner 3 may be installed in the structure A through the mounting assembly 2. However, the present disclosure is not limited thereto. For example, unlike shown in FIG. 1, the air conditioner 3 may be mounted on the structure A without the mounting assembly 2. For example, unlike shown in FIG. 1, the air conditioner 3 may be configured to perform an air conditioning function without being mounted on the structure A.

The air conditioner 3 may be configured to cool or heat the indoor space I. The air conditioner 3 may be configured to exchange heat between indoor air and outdoor air, respectively. For example, the air conditioner 3 may perform a heat exchange operation using a refrigerant cycle, and may be configured to exchange heat with indoor air and the refrigerant, and may be configured to exchange heat with the outdoor air and the refrigerant. The air conditioner 3 may be configured to absorb heat from indoor air and transfer heat to outdoor air when cooling the indoor space I. Additionally, the air conditioner 3 may be configured to transfer heat to indoor air and absorb heat from outdoor air when heating the indoor space I.

A portion of the air conditioner 3 may be arranged to face the indoor space I. Another portion of the air conditioner 3 may be arranged to face the outdoor space O.

The air conditioning system 1 described above with reference to FIG. 1 is simply an example of a system for installing and operating an air conditioner in an air conditioning system according to the present disclosure, and the present disclosure is not limited thereto.

Figure 2:
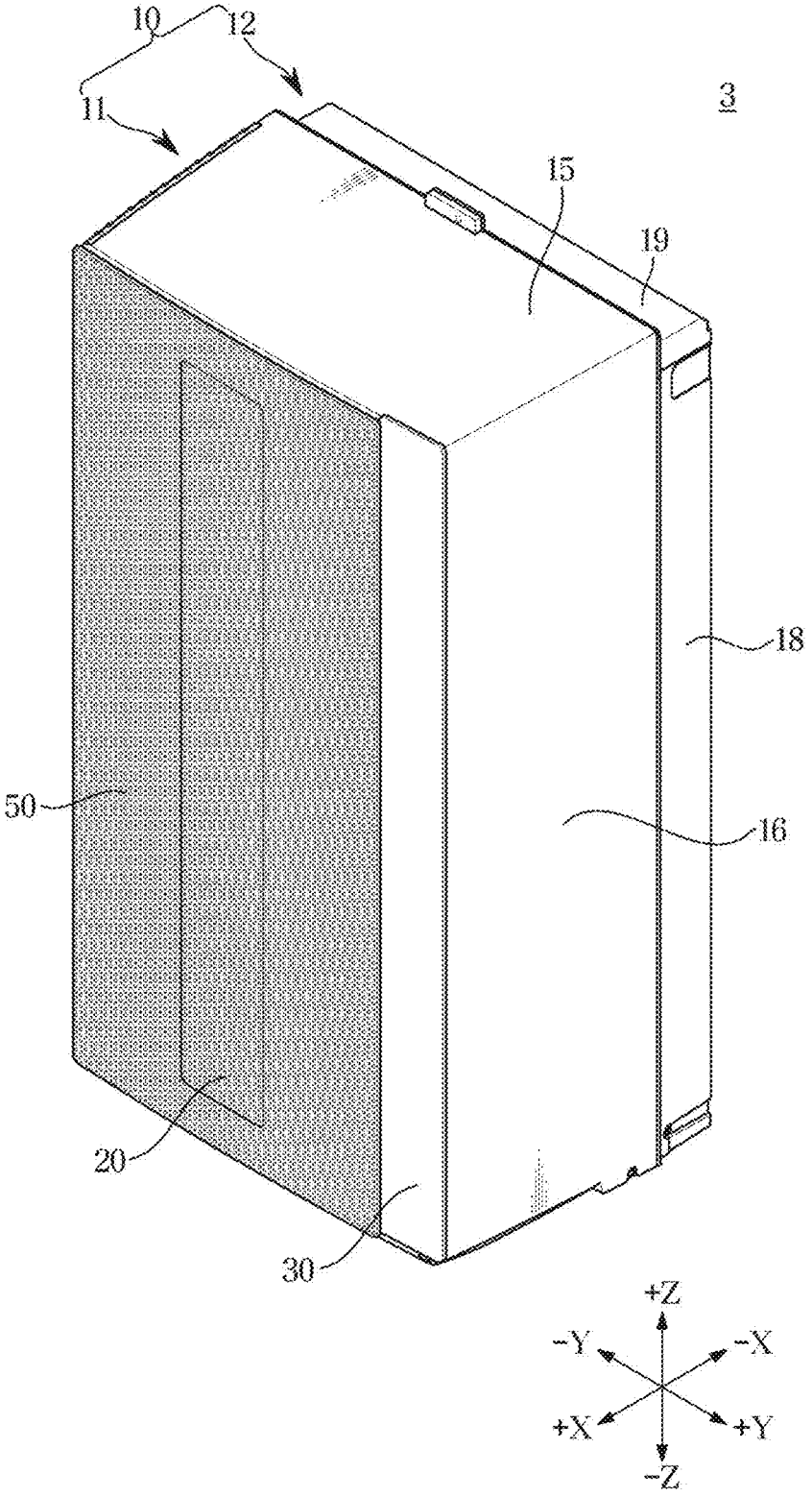
FIG. 2 is a perspective view illustrating an air conditioner when viewed from one direction according to various embodiments.
Figure 3:
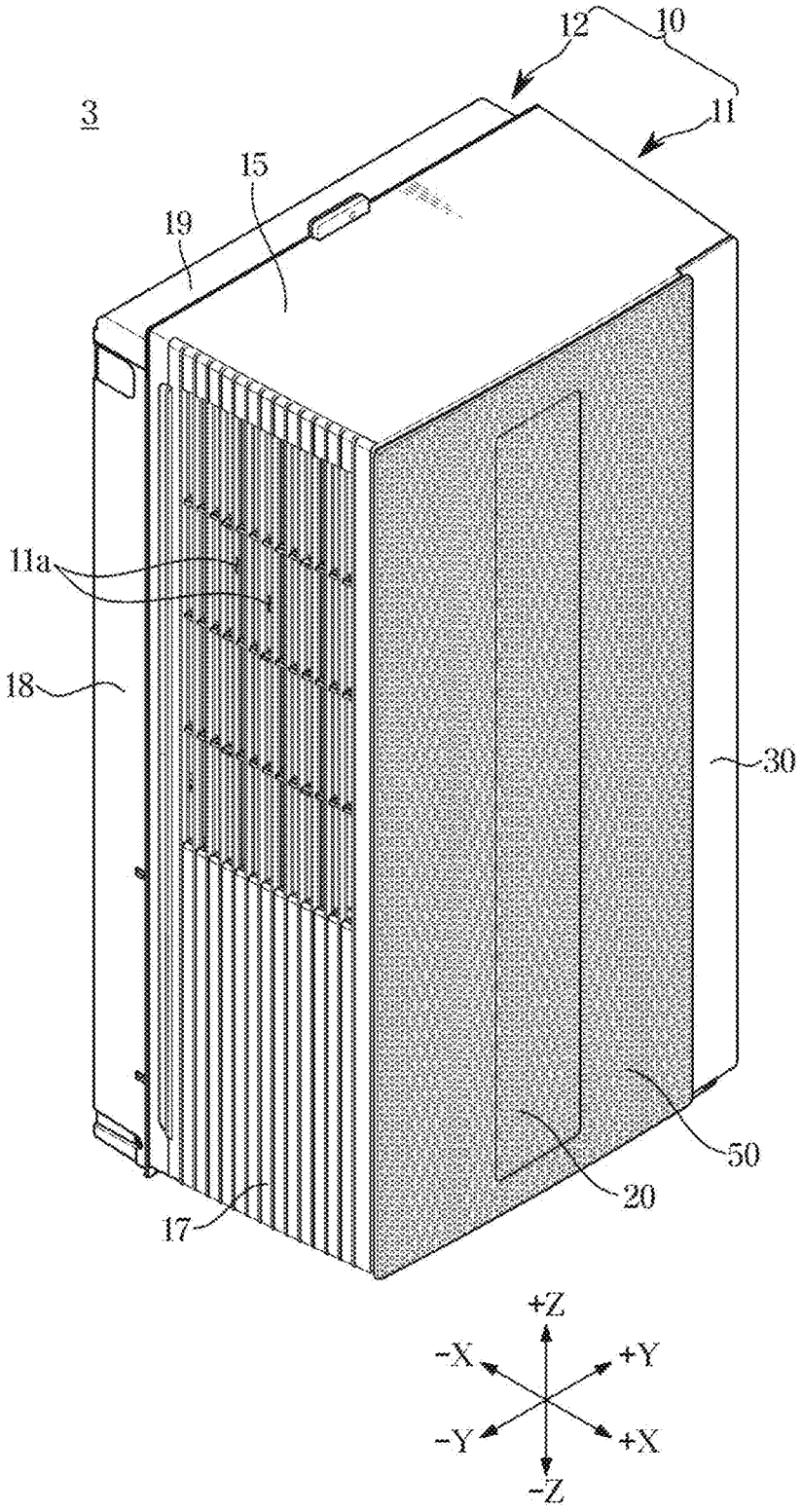
FIG. 3 is a perspective view illustrating the air conditioner when viewed from another direction according to various embodiments.
Figure 4:
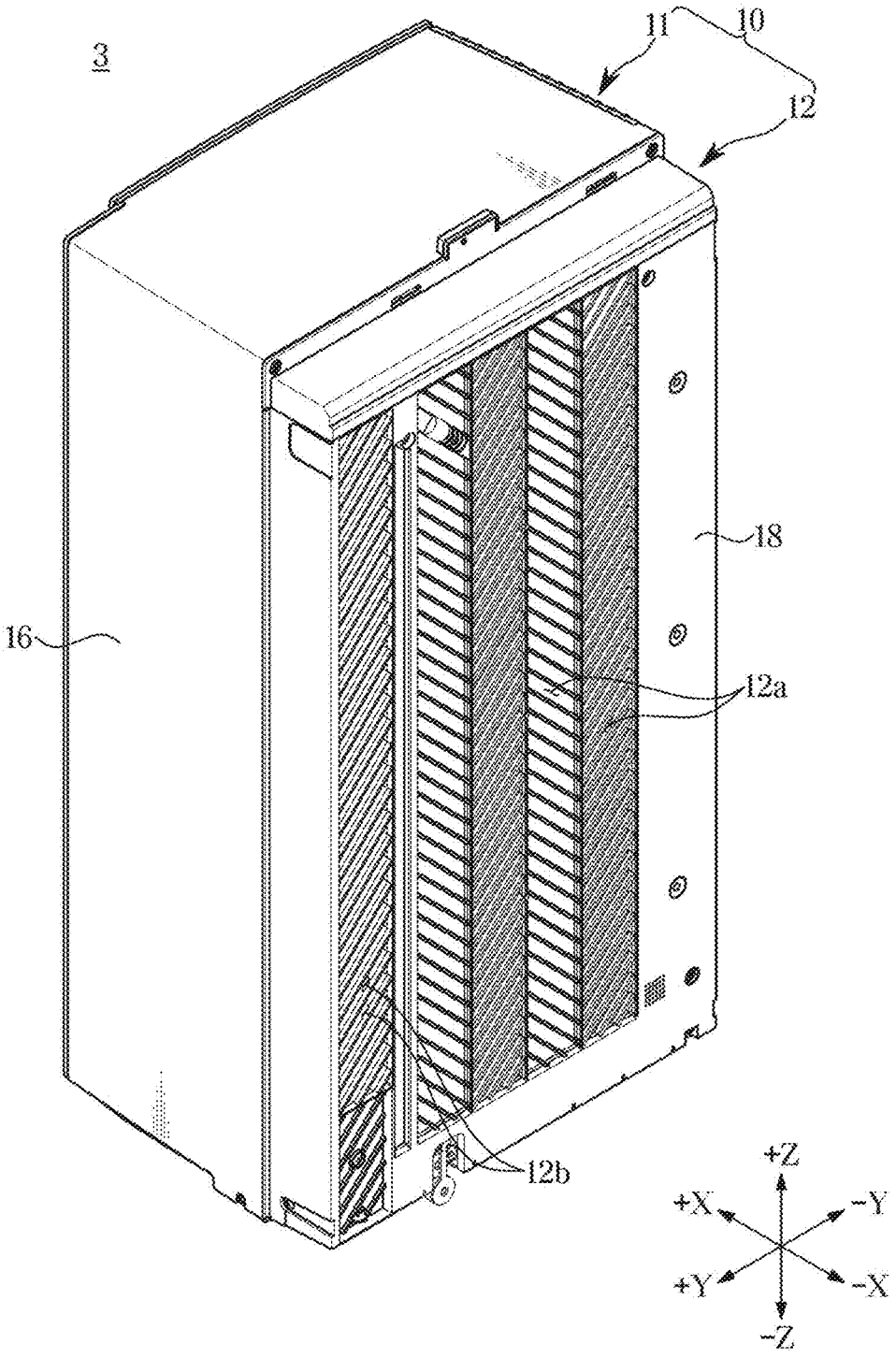
FIG. 4 is a rear perspective view of the air conditioner according to various embodiments.
Figure 5:
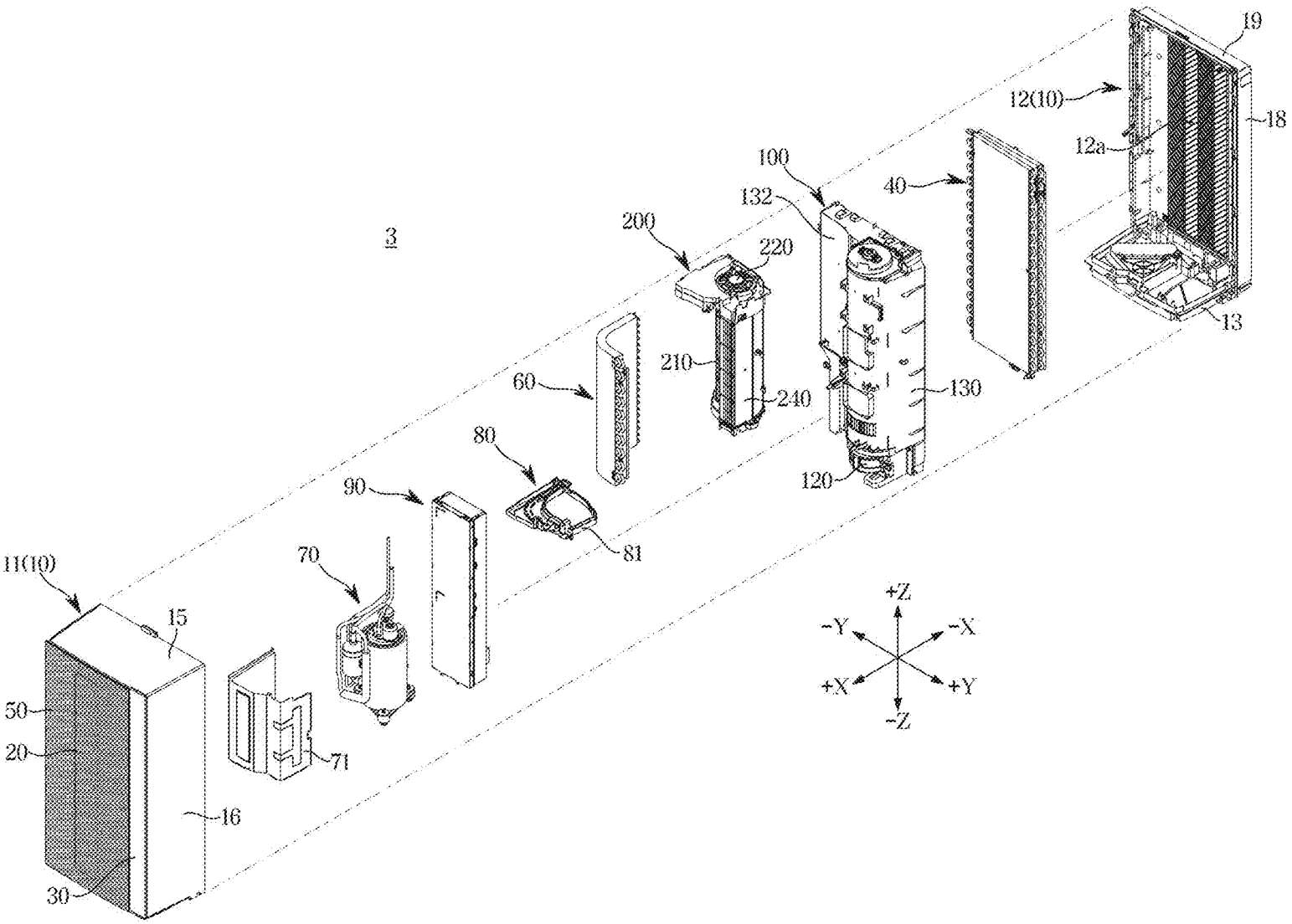
FIG. 5 is an exploded perspective view of the air conditioner according to various embodiments.
Figure 6:
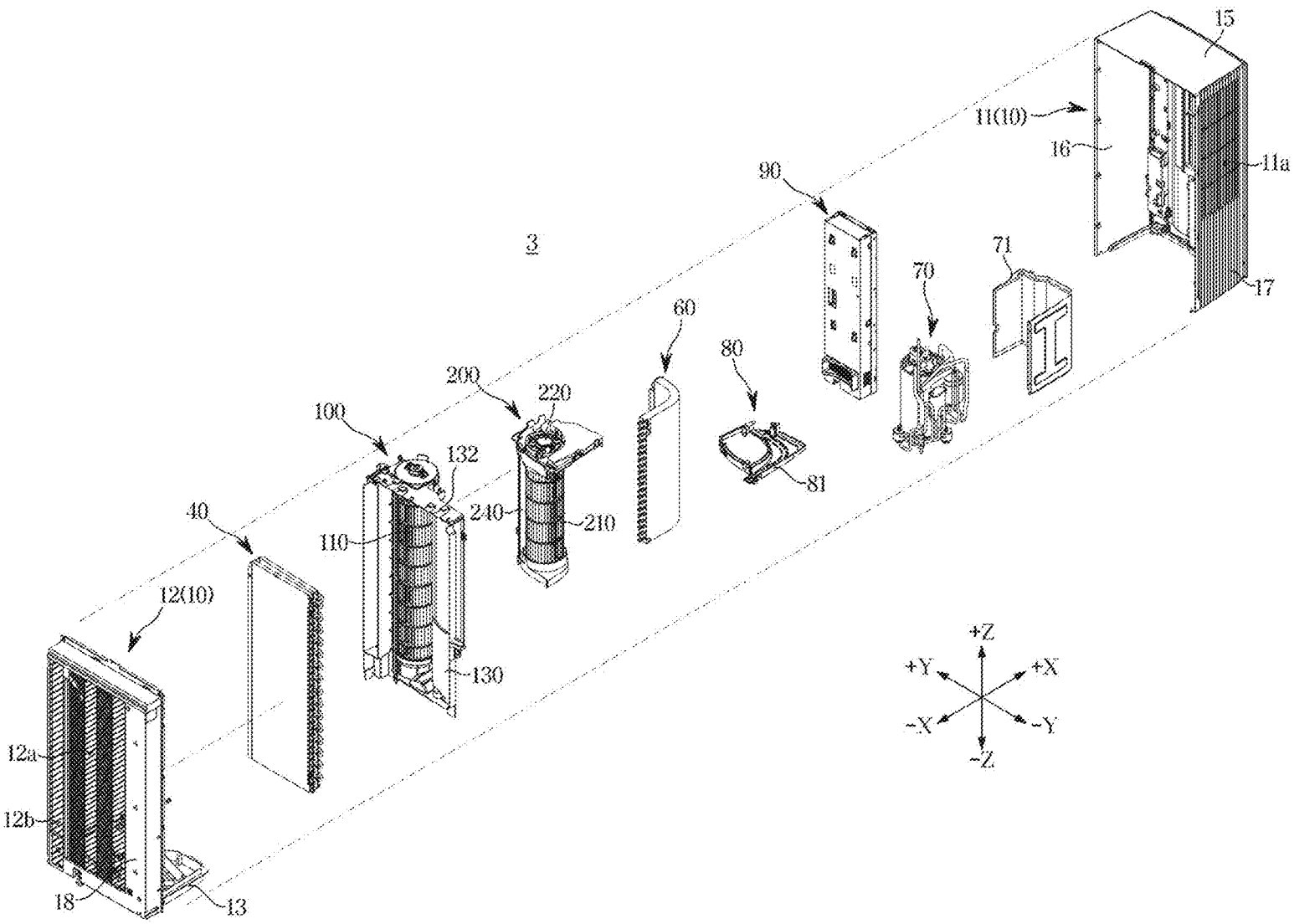
FIG. 6 is an exploded perspective view of the air conditioner according to various embodiments.
Figure 7:
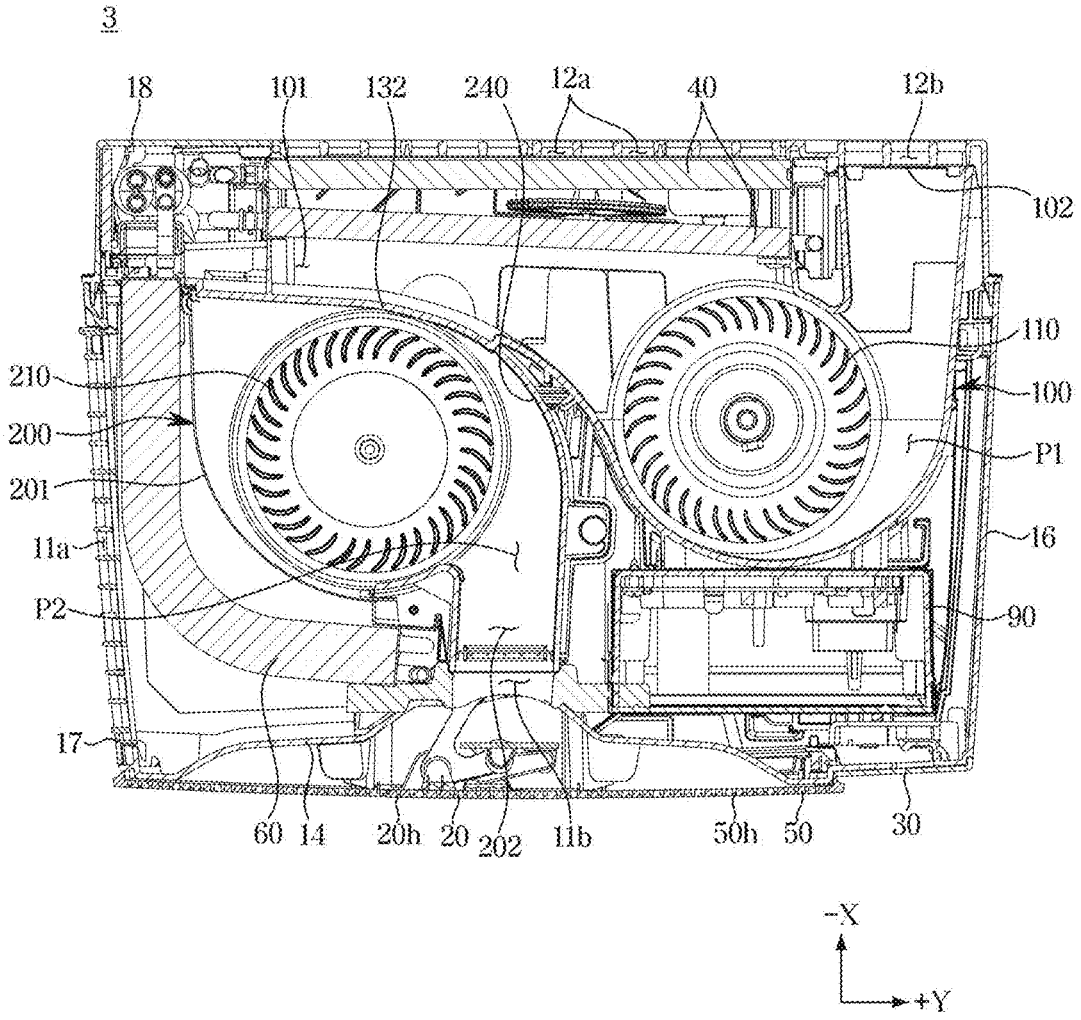
FIG. 7 is a cross-sectional view of the air conditioner according to various embodiments.

FIG. 2 is a perspective view illustrating an air conditioner when viewed from one direction according to various embodiments. FIG. 3 is a view illustrating the air conditioner when viewed from another direction according to various embodiments. FIG. 4 is a rear perspective view of the air conditioner according to various embodiments. FIG. 5 is an exploded perspective view of the air conditioner according to various embodiments. FIG. 6 is an exploded perspective view of the air conditioner according to various embodiments. FIG. 7 is a cross-sectional view of the air conditioner according to various embodiments.

Referring to FIGS. 2, 3, 4, 5, 6 and 7 (which may be referred to as FIGS. 2 to 7), the air conditioner 3 according to an embodiment of the present disclosure may include a housing 10. The housing 10 may be provided to form an overall appearance of the air conditioner 3. The housing 10 may form at least a portion of an outer surface of the air conditioner 3. The housing 10 may be provided to accommodate various components of the air conditioner 3. The housing 10 may have a substantially box shape.

For example, the housing 10 may include a front case 11. For example, the housing 10 may include a rear case 12. The front case 11 may be provided to be removably couplable to the rear case 12.

The front case 11 may be arranged to face the indoor space I (refer to FIG. 1). For example, the front case 11 may be provided to form at least a portion of a front exterior of the air conditioner 3.

The rear case 12 may be arranged to face the outdoor space O (refer to FIG. 1). For example, the rear case 12 may be provided to form at least a portion of a rear exterior of the air conditioner 3.

For example, the housing 10 may include a front panel 14. The front panel 14 may form at least a portion of a front surface of the housing 10. A second outlet 11*b*, which will be described in greater detail below, may be formed on the front panel 14.

The front panel 14 may be at least partially covered by a discharge panel 50, which will be described in greater detail below. For example, as shown in FIGS. 2 to 7, the front panel 14 may be substantially entirely covered by the discharge panel 50, and as a result, the front panel 14 may not be visible on the front exterior of the air conditioner 3. However, it is not limited thereto, and a portion of the front panel 14 may be covered by the discharge panel 50, but the other portion of the front panel 14 may not be covered by the discharge panel 50 and thus exposed to the outside. Accordingly, the front panel 14 may form a portion of the front exterior of the air conditioner 3.

For example, the housing 10 may include a top panel 15. The top panel 15 may form an upper surface of the air conditioner 3.

For example, the housing 10 may include a first side panel 16. The first side panel 16 may form a right surface of both sides surfaces in a horizontal direction (Y direction) of the air conditioner 3.

For example, the housing 10 may include a second side panel 17. The second side panel 17 may form a left surface of both side surfaces in the horizontal direction (Y direction) of the air conditioner 3. The second side panel 17 may be provided on the opposite side of the first side panel 16.

For example, the housing 10 may include a rear panel 18. The rear panel 18 may form a rear surface of the air conditioner 3.

For example, the housing 10 may include a base 13. The base 13 may form a lower surface of the air conditioner 3. The base 13 may be provided to support at least some components disposed inside the air conditioner 3.

For example, the housing 10 may include a top cover 19. For example, the top cover 19 may be provided to form a portion of the upper surface and/or a portion of the rear surface of the air conditioner 3. However, the housing 10 may not include a separate top cover 19. For example, the top cover 19 may be provided as a part of the top panel 15 or as a part of the rear panel 18. For example, a part of the top cover 19 may be provided as a part of the top panel 15, and another part of the top cover 19 may be provided as a part of the rear panel 18.

For example, referring to FIGS. 2 to 7, it is illustrated that the front case 11 includes the front panel 14, the top panel 15, the first side panel 16, and the second side panel 17, but the present disclosure is not limited thereto. For example, the front case 11 may be formed to include only the front panel 14 and the top panel 15. For example, the front case 11 may further include components other than the front panel 14, the top panel 15, the first side panel 16, and the second side panel 17.

For example, referring to FIGS. 2 to 7, it is illustrated that the rear case 12 includes the rear panel 18, the base 13, and the top cover 19, but the present disclosure is not limited thereto. For example, the rear case 12 may be formed to include only the rear panel 18. For example, the rear case 12 may further include components other than the rear panel 18, the base 13, and the top cover 19.

The housing 10 of the air conditioner 3 described above is only an example of the housing provided in the air conditioner according to the present disclosure, but the present disclosure is not limited thereto. The air conditioner according to the present disclosure may include a housing having various structures and shapes.

The housing 10 may include a first inlet 12*a* through which outdoor air flows. Outdoor air may flow into the housing 10 through the first inlet 12*a*.

The first inlet 12*a* may be arranged to face the outdoor space O (refer to FIG. 1). The first inlet 12*a* may be in communication with the outdoor space O. For example, the first inlet 12*a* may be formed in the rear case 12 to allow outdoor air to be introduced. For example, the first inlet 12*a* may be formed in the rear panel 18. However, the present disclosure is not limited thereto, and the first inlet 12*a* may be formed in various parts of the housing 10 facing the outdoor space O.

The housing 10 may include a first outlet 12*b* formed to allow air that is heat-exchanged with a first heat exchanger 40 to be discharged to the outdoor space O. Outdoor air introduced into the housing 10 through the first inlet 12*a* may be heat-exchanged with the first heat exchanger 40 and then discharged to the outdoor space O through the first outlet 12*b*.

The first outlet 12*b* may be arranged to face the outdoor space O (refer to FIG. 1). The first outlet 12*b* may be in communication with the outdoor space O. For example, the first outlet 12*b* may be formed in the rear case 12. For example, the first outlet 12*b* may be formed in the rear panel 18. However, the present disclosure is not limited thereto, and the first outlet 12*b* may be formed in various parts of the housing 10 facing the outdoor space O.

The first outlet 12*b* may be distinguished from the first inlet 12*a*. The first outlet 12*b* may be formed to be spaced apart from the first inlet 12*a*.

A first flow path P1 may be formed inside the housing 10. The first flow path P1 may be formed to allow air, introduced from the outdoors, to flow. The first flow path P1 may be formed between the first inlet 12*a* and the first outlet 12*b*. For example, the first heat exchanger 40 may be disposed on the first flow path P1. For example, a first fan assembly 100 may be disposed on the first flow path P1.

The housing 10 may include a second inlet 11*a* through which indoor air flows. Indoor air may flow into the housing 10 through the second inlet 11*a*.

The second inlet 11*a* may be arranged to face the indoor space I (refer to FIG. 1). The second inlet 11*a* may be in communication with the indoor space I. For example, the second inlet 11*a* may be formed in the front case 11 to allow indoor air to be introduced. For example, the second inlet 11*a* may be formed in the second side panel 17. However, the present disclosure is not limited thereto, and the second inlet 11*a* may be formed in various parts of the housing 10 facing the indoor space I.

The housing 10 may include a second outlet 11*b* formed to allow air that is heat-exchanged with a second heat exchanger 60 to be discharged to the outside of the housing 10. The indoor air introduced into the housing 10 through the second inlet 11*a* may be heat-exchanged with the second heat exchanger 60 and then discharged to the outside of the housing 10 through the second outlet 11*b*. As will be described in greater detail below, the air discharged to the outside of the housing 10 through the second outlet 11*b* may be discharged to the indoor space I (refer to FIG. 1) through an opening formed on the discharge panel 50 or a plurality of discharge holes 50*h*, each of which has a smaller size than the opening.

The second outlet 11*b* may be arranged to face the indoor space I (refer to FIG. 1). The second outlet 11*b* may be in communication with the indoor space I. For example, the second outlet 11*b* may be formed in the front case 11. For example, the second outlet 11*b* may be formed in the front panel 14 and may be covered by the discharge panel 50. However, the present disclosure is not limited thereto, and the second outlet 11*b* may be formed in various parts of the housing 10 facing the indoor space I.

The second outlet 11*b* may be distinguished from the second inlet 11*a*. The second outlet 11*b* may be formed to be spaced apart from the second inlet 11*a*.

A second flow path P2 may be formed inside the housing 10. The second flow path P2 may be formed to allow air, introduced from the indoor space, to flow. The second flow path P2 may be formed between the second inlet 11*a* and the second outlet 11*b*. For example, the second heat exchanger 60 may be disposed on the second flow path P2. For example, a second fan assembly 200 may be disposed on the second flow path P2.

The first flow path P1 and the second flow path P2 may be arranged to be partitioned from each other. Outdoor air flowing through the first flow path P1 and indoor air flowing through the second flow path P2 may not mix inside the housing 10.

The air conditioner 3 may include the discharge panel 50. The discharge panel 50 may cover at least a portion of the housing 10. Particularly, the discharge panel 50 may cover a portion of the housing 10 in which the second outlet 11*b* is formed. The discharge panel 50 may be disposed on one side of the second outlet 11*b*. The discharge panel 50 may be arranged to be spaced apart from the second outlet 11*b*.

For example, the discharge panel 50 may cover the front panel 14 in which the second outlet 11*b* is formed. The discharge panel 50 may form at least a portion of the front exterior of the air conditioner 3.

The discharge panel 50 may be provided to allow at least a portion of the air, which is discharged through the second outlet 11*b*, to be discharged. For example, after the indoor air, which is introduced into the housing 10 from the indoor space I (refer to FIG. 1) through the second inlet 11*a*, is heat exchanged with the second heat exchanger 60, at least a portion of the heat exchanged air may sequentially pass through the second outlet 11*b* and the discharge panel 50 and be discharged back into the indoor space I.

For example, the discharge panel 50 may include the plurality of discharge holes 50*h* through which air flowing from the second outlet 11*b* is discharged. The plurality of discharge holes 50*h* formed in the discharge panel 50 may be formed to have a smaller size than the second outlet 11*b*.

An opening through which air discharged through the second outlet 11*b* is discharged may be formed in the discharge panel 50. The opening formed in the discharge panel 50 may be formed to have a larger size than each of the plurality of discharge holes 50*h* described above.

The discharge panel 50 may be coupled to the housing 10. Particularly, the discharge panel 50 may be coupled to the front case 11. The discharge panel 50 may maintain a fixed position relative to the housing 10.

The discharge panel 50 may be formed in a substantially flat plate shape. However, it is not limited thereto, and the discharge panel 50 may be formed in various shapes.

The air conditioner 3 may include a blade 20. The blade 20 may be provided to open or cover the opening of the discharge panel 50. The blade 20 may have a shape that approximately corresponds to the opening of the discharge panel 50.

At a position spaced apart from the second outlet 11*b*, the blade 20 may be provided to cover the opening of the discharge panel 50. The blade 20 may be arranged to be approximately parallel to the discharge panel 50 when covering the opening of the discharge panel 50.

The blade 20 may be provided to be rotatable with respect to the housing 10. Additionally, the blade 20 may be provided to be rotatable with respect to the discharge panel 50. The blade 20 may be coupled to the housing 10.

The blade 20 may be provided to guide indoor air discharged through the opening of the discharge panel 50. The blade 20 may be provided to adjust a discharge direction of air discharged into the indoor space through the opening of the discharge panel 50.

In a state of covering the second outlet 11*b* or the opening of the discharge panel 50, the blade 20 may allow a portion of the air discharged from the second outlet 11*b* to be discharged. For example, after the indoor air, which is introduced into the housing 10 from the indoor space I (refer to FIG. 1) through the second inlet 11*a*, is heat exchanged with the second heat exchanger 60, at least a portion of the heat exchanged air may sequentially pass through the second outlet 11*b* and the blade 20 and be discharged back into the indoor space I.

For example, the blade 20 may include a plurality of discharge holes 20*h* through which air flowing from the second outlet 11*b* is discharged. The plurality of discharge holes 20*h* formed in the blade 20 may be formed to allow each discharge hole 20*h* to have a smaller size than the second outlet 11*b*. In a state in which the blade 20 covers the second outlet 11*b* or the opening of the discharge panel 50, a portion of the air discharged from the second outlet 11*b* may be discharged through the plurality of discharge holes 20*h* of the blade 20.

The air conditioner 3 according to an embodiment of the present disclosure may operate in a wind-free operation mode to implement a wind-free airflow. The wind-free operation mode may refer, for example, to a low-air volume operation mode in which air is discharged below a certain speed while preventing/reducing blowing directly to a user. When the air conditioner 3 operates in the wind-free operation mode, air that is heat exchanged with the heat exchanger 60 may be discharged through the plurality of discharge holes 50*h* of the discharge panel 50 and/or the plurality of discharge holes 20*h* of the blade 20. At this time, the blade 20 may be arranged to cover the opening of the discharge panel 50.

When the blade 20 is arranged to open the opening of the discharge panel 50, most of the air heat exchanged with the heat exchanger 60 may be discharged through the opening of the discharge panel 50.

The air conditioner 3 may include the first heat exchanger 40. The first heat exchanger 40 may be configured to exchange heat with outdoor air introduced through the first inlet 12*a*. The first heat exchanger 40 may be disposed inside the housing 10. The first heat exchanger 40 may be disposed on the first flow path P1. The first heat exchanger 40 may be arranged to face the first inlet 12*a*. The first heat exchanger 40 may be referred to as an 'outdoor heat exchanger' in that the heat exchanger exchanges heat with outdoor air.

The air conditioner 3 may include the second heat exchanger 60. The second heat exchanger 60 may be configured to exchange heat with indoor air introduced through the second inlet 11*a*. The second heat exchanger 60 may be disposed inside the housing 10. The second heat exchanger 60 may be disposed on the second flow path P2. At least a portion of the second heat exchanger 60 may be arranged to face the second inlet 11*a*. For example, the second heat exchanger 60 may be arranged to surround at least a portion of the second fan assembly 200. For example, the second heat exchanger 60 may be provided to cover at least a portion of the second fan assembly 200. The second heat exchanger 60 may also be referred to as an 'indoor heat exchanger' in that the heat exchanger exchanges heat with indoor air.

For example, the first heat exchanger 40 may be provided as a condenser, and the second heat exchanger 60 may be provided as an evaporator. The air conditioner 3 may be configured to cool the indoor space. However, it is not limited thereto. The first heat exchanger 40 may be provided as an evaporator, and the second heat exchanger 60 may be provided as a condenser. The air conditioner 3 may be configured to heat the indoor space.

The air conditioner 3 may include a drain pan 80. The drain pan 80 may be configured to collect condensed water generated in the second heat exchanger 60. The drain pan 80 may be provided to support the second heat exchanger 60. The drain pan 80 may be provided to support the second fan assembly 200. For example, the drain pan 80 may include a seating portion 81 on which a base 230 of the second fan assembly 200 is seated.

The air conditioner 3 may include a compressor 70. The compressor 70 may be configured to compress the refrigerant for the heat exchange operation by the first heat exchanger 40 and the second heat exchanger 60. The compressor 70 may be configured to compress the refrigerant to a high-temperature and high-pressure state. The refrigerant compressed in the compressor 70 may flow into the first heat exchanger 40 or the second heat exchanger 60.

For example, the compressor 70 may be disposed below the second fan assembly 200. For example, the compressor 70 may be disposed below the drain pan 80.

The air conditioner 3 may include a compressor cover 71. The compressor cover 71 may be provided to cover the compressor 70. The compressor cover 71 may prevent and/or block the compressor 70 from being exposed to the outside. The compressor cover 71 may be provided to protect the compressor 70.

The air conditioner 3 may include an expansion device. The expansion device may be configured to expand the refrigerant discharged from the first heat exchanger 40 or the refrigerant discharged from the second heat exchanger 60.

The air conditioner 3 may include a control box 90. The control box 90 may accommodate a printed circuit board on which various electronic components are mounted.

The air conditioner 3 may include a control panel 30. The control panel 30 may be arranged to obtain a user input. Further, the control panel 30 may be provided to display information about operation, status, various settings, indoor temperature and humidity, etc. of the air conditioner 3. The control panel 30 may be electrically connected to a controller of the air conditioner 3. For example, the control panel 30 may be disposed in a front portion of the front case 11.

The air conditioner 3 may include the first fan assembly 100. The first fan assembly 100 may be configured to move outdoor air within the housing 10. The first fan assembly 100 may be configured to move outdoor air between the first inlet 12*a* and the first outlet 12*b*.

For example, a suction side 101 of the first fan assembly 100 may be provided to face the first inlet 12*a*. For example, a discharge side 102 of the first fan assembly 100 may be provided to face the first outlet 12*b*.

The first fan assembly 100 may include a first fan 110. For example, the first fan 110 may be arranged to face at least a portion of the first heat exchanger 40.

The first fan assembly 100 may include a first fan motor 120 for driving the first fan 110.

The first fan assembly 100 may include a first frame 130 provided to guide outdoor air. For example, the first frame 130 may extend along an extension direction of the first fan 110. For example, the first frame 130 may have a shape extending approximately in the vertical direction (Z direction).

The air conditioner 3 may include the second fan assembly 200. The second fan assembly 200 may be configured to move indoor air within the housing 10. The second fan assembly 200 may be configured to move indoor air between the second inlet 11*a* and the second outlet 11*b*.

For example, a suction side 201 of the second fan assembly 200 may be provided to face the second inlet 11*a*. For example, a discharge side 202 of the second fan assembly 200 may be provided to face the second outlet 11*b*. For example, the discharge side 202 of the second fan assembly 200 may be arranged to face the blade 20.

The second fan assembly 200 may include a second fan 210. For example, the second fan 210 may be arranged to face at least a portion of the second heat exchanger 60.

The second fan assembly 200 may include a second fan motor 220 for driving the second fan 210.

The second fan assembly 200 may include a second frame 240 provided to guide indoor air. For example, the second frame 240 may extend along an extension direction of the second fan 210. For example, the second frame 240 may have a shape extending approximately in the vertical direction (Z direction).

Referring to FIG. 7, the first frame 130 and the second frame 240 may be arranged to be in contact with each other. For example, the first frame 130 and the second frame 240 may be provided to allow the first fan 110 and the second fan 210 to be partitioned from each other. For example, a partition 132 of the first frame 130 and the second frame 240 may be provided to be coupled to the first fan 110 and the second fan 210, respectively, so as to allow the first fan 110 and the second fan 210 to be partitioned from each other. For example, the first frame 130 and the second frame 240 may be provided to allow the first flow path P1 and the second flow path P2 to be partitioned from each other. As a result, indoor air and outdoor air may not mix inside the housing 10.

The configurations of the air conditioner 3 described above with reference to FIGS. 2 to 7 are simply examples of configurations provided in the air conditioner according to the present disclosure, and the air conditioner according to the present disclosure may include various configurations.

Figure 8:
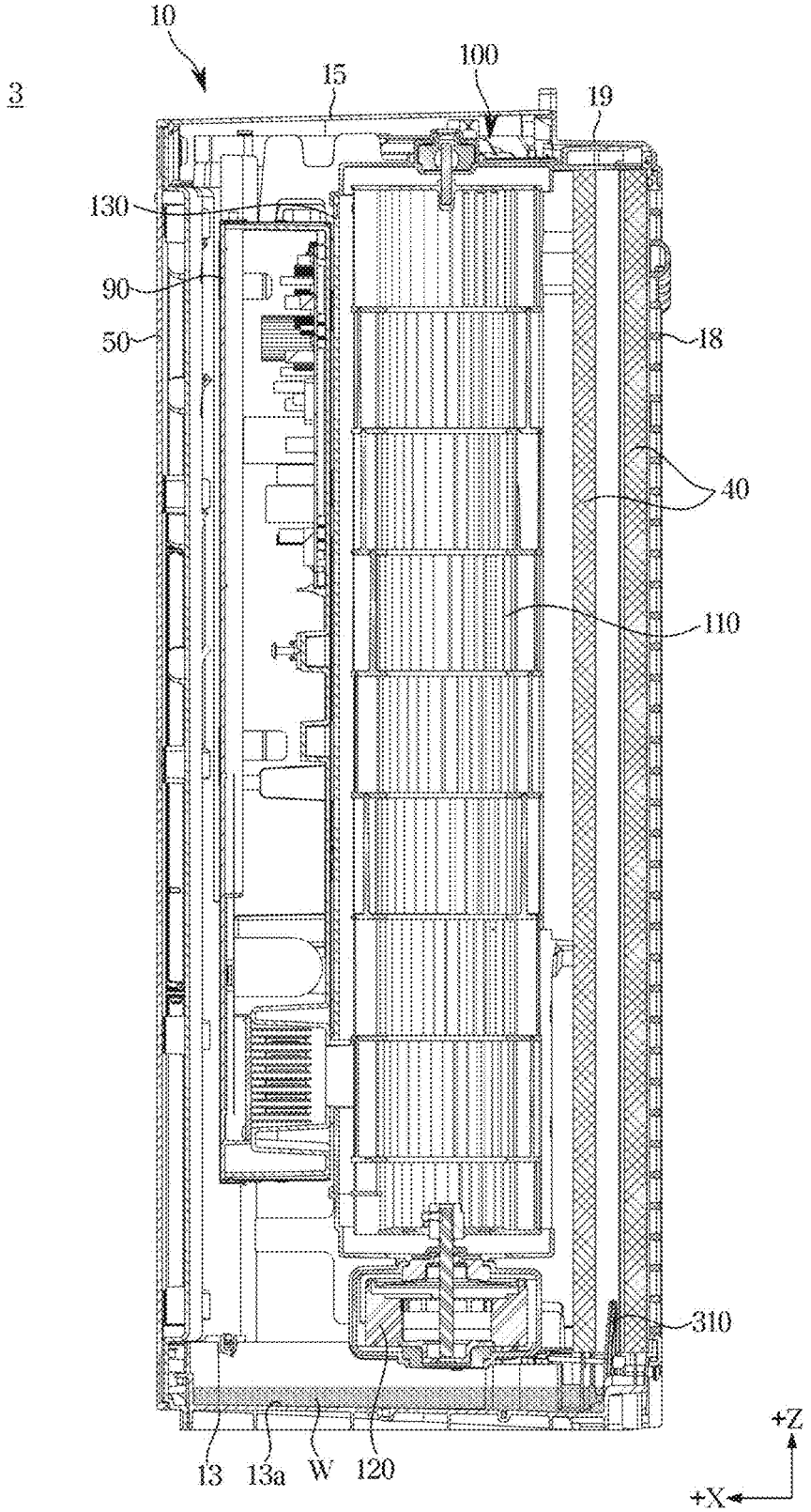
FIG. 8 is a side cross-sectional view of the air conditioner according to various embodiments.

FIG. 8 is a side cross-sectional view of the air conditioner according to various embodiments.

Referring to FIG. 8, the air conditioner 3 according to an embodiment of the present disclosure may generate condensed water W in the process of performing the heat exchange operation through the refrigerant cycle.

For example, during a cooling operation of the air conditioner 3, a surface of the second heat exchanger 60, which exchanges heat with indoor air, may be cooled by a refrigerant. In the process of the heat exchange between air containing water vapor and the second heat exchanger 60, condensed water W generated by condensation of water vapor may form on the surface of the cooled second heat exchanger 60.

For example, the condensed water W condensed in the second heat exchanger 60 may be primarily collected in the drain pan 80 (refer to FIGS. 5 and 6) arranged below the second heat exchanger 60. Thereafter, the condensed water W collected in the drain pan 80 may be moved to the base 13 located below the drain pan 80 and collected. However, it is not limited thereto, and the condensed water W condensed in the second heat exchanger 60 may be moved to the base 13 and collected through various processes.

The base 13 may include a water collector 13*a* provided to collect condensed water W. The water collector 13*a* may be arranged on one surface of the base 13 facing an internal space of the housing 10.

For example, the water collector 13*a* may be formed to be inclined with respect to the front and rear direction X of the air conditioner 3. For example, the water collector 13*a* may be inclined with respect to the front and rear direction X of the air conditioner 3 to extend downward (−Z direction) as being directed to the rear (−X direction) of the air conditioner 3. Accordingly, the condensed water W in the water collector 13*a* may be moved to the rear (−X direction) of the air conditioner 3.

However, it is not limited thereto, and the water collector 13*a* may be formed parallel to the front and rear direction X of the air conditioner 3.

The above description is only an example of the process in which water is collected in the base 13 in the air conditioner 3 according to an embodiment of the present disclosure, but water may be collected in the base 13 through various processes. For example, when the air conditioner 3 is in the cooling operation, dew may form on various parts on the flow path, through which cold air passes, in a process in which the cold air generated by the second heat exchanger 60 is discharged through the second outlet 11*b*, the discharge panel 50, and the blade 20. Accordingly, the dew may be moved to the base 13 and collected by gravity. When the air conditioner 3 is installed in a window (structure A) as illustrated in FIG. 1, the rear panel 18 of the housing 10 may be exposed to the outdoor space O. Therefore, when it rains, there is a possibility that rainwater flows into the housing 10 from the outdoor space O through the first inlet 12*a* and the first outlet 12*b* formed in the rear panel 18. In this way, not only water generated inside the housing 10, but also water introduced from the outside of the housing 10 for various reasons may be collected in the base 13.

Hereinafter a process of evaporating water stored in the base by scattering the water, and removing foreign substances accumulating in the condenser is described in greater detail.

As the air conditioner 3 according to the present disclosure is mainly characterized by the operation in the refrigeration cycle, the air conditioner 3 will be described under the assumption that the above-mentioned first heat exchanger 40 is the condenser 40 and the above-mentioned second heat exchanger 60 is the evaporator 60. Further, it is assumed that the first fan 110 provided around the first heat exchanger 40 is described as an outdoor fan 110, and the first fan motor 120 configured to rotate the first fan 110 is a fan motor 120.

Figure 9:
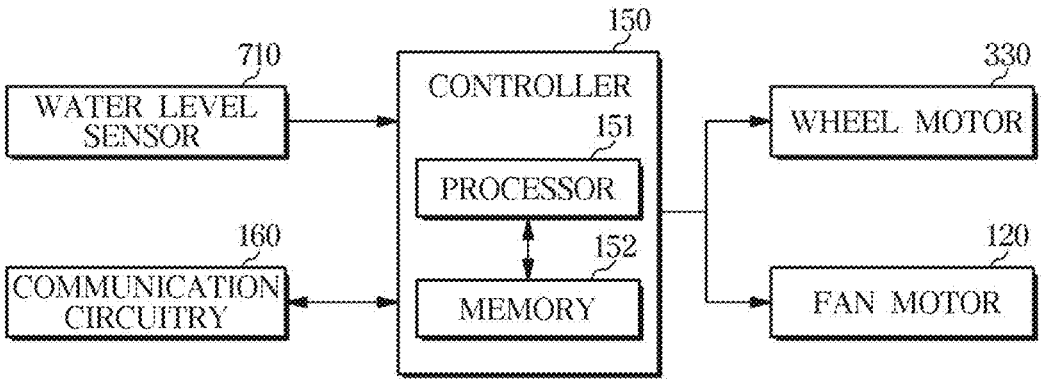
FIG. 9 is a block diagram illustrating an example configuration of the air conditioner according to various embodiments.

FIG. 9 is a block diagram illustrating an example configuration of the air conditioner according to various embodiments.

The air conditioner 3 may further include a water level sensor 710, a scattering wheel 310 (refer to FIG. 8), a wheel motor 330, an outdoor fan 110, a fan motor 120, and a controller (e.g., including various circuitry) 150 in addition to the evaporator 60, the condenser 40, and the base. The controller 150 may include at least one processor (e.g., comprising processing circuitry) 151 and memory 152.

The water level sensor 710 may detect a water level of the water stored in the base provided under the evaporator. For example, when the water is stored up to a first water level, the water level sensor 710 may detect the first water level and when the water is stored up to a second water level, the water level sensor 710 may detect the second water level. The second water level may be higher than the first water level. The water level sensor 710 is not limited thereto and may detect various water levels.

The scattering wheel 310 may scatter the water stored in the evaporator, and the wheel motor 330 may provide power to the scattering wheel 310 to rotate the scattering wheel 310. A detailed description thereof will be provided below The outdoor fan 110 may blow outdoor air to the condenser 40 to promote heat exchange of the condenser 40, and the fan motor 120 may provide power to the outdoor fan 110 to rotate the outdoor fan 110. A detailed description thereof will be provided below.

The communication circuitry 160 may communicate with a server, etc. The controller 150 may perform various controls to be described in greater detail below based on the information received through the communication circuitry.

The controller 150 may include the memory 152 storing a control program and control data for controlling the wheel motor 330 and the fan motor 120, and the processor 151 configured to generate a control signal according to the control program and control data stored in the memory. The memory 152 and the processor 151 may be provided integrally or separately.

The memory 152 may store programs and data for controlling the wheel motor 330 and the fan motor 120.

The memory 152 may include a volatile memory such as Static Random Access Memory (S-RAM) and Dynamic Random Access Memory (D-RAM) for temporarily storing data. In addition, the memory 152 may include a non-volatile memory such as Read Only Memory (ROM), Erasable Programmable Read Only Memory (EPROM), and Electrically Erasable Programmable Read Only Memory (EEPROM) for storing data for a long period of time.

The processor 151 may include various logic circuits and operation circuits, process data according to a program provided from the memory 152, and generate a control signal according to the processing result. The processor 151 may include various processing circuitry and/or multiple processors. For example, as used herein, including the claims, the term "processor" may include various processing circuitry, including at least one processor, wherein one or more of at least one processor, individually and/or collectively in a distributed manner, may be configured to perform various functions described herein. As used herein, when "a processor", "at least one processor", and "one or more processors" are described as being configured to perform numerous functions, these terms cover situations, for example and without limitation, in which one processor performs some of recited functions and another processor(s) performs other of recited functions, and also situations in which a single processor may perform all recited functions. Additionally, the at least one processor may include a combination of processors performing various of the recited/disclosed functions, e.g., in a distributed manner. At least one processor may execute program instructions to achieve or perform various functions.

This controller 150 may rotate the wheel motor 330 and the fan motor 120 based on the termination of the operation of the air conditioner 3 and the detection result of the water level sensor 710. A detailed description thereof will be provided below.

Figure 10:
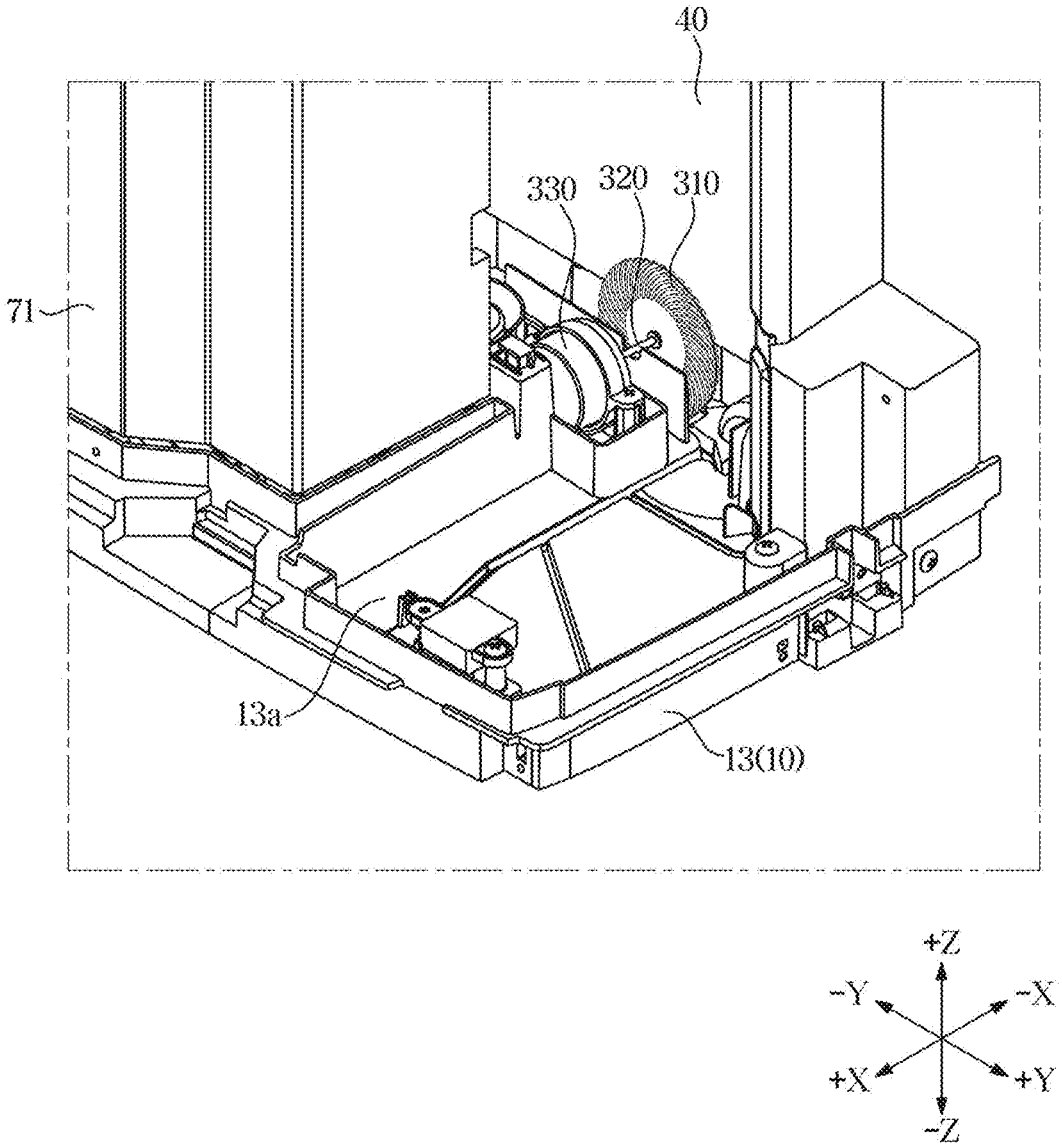
FIG. 10 is a partial perspective view of various components of the air conditioner according to various embodiments.
Figure 11:
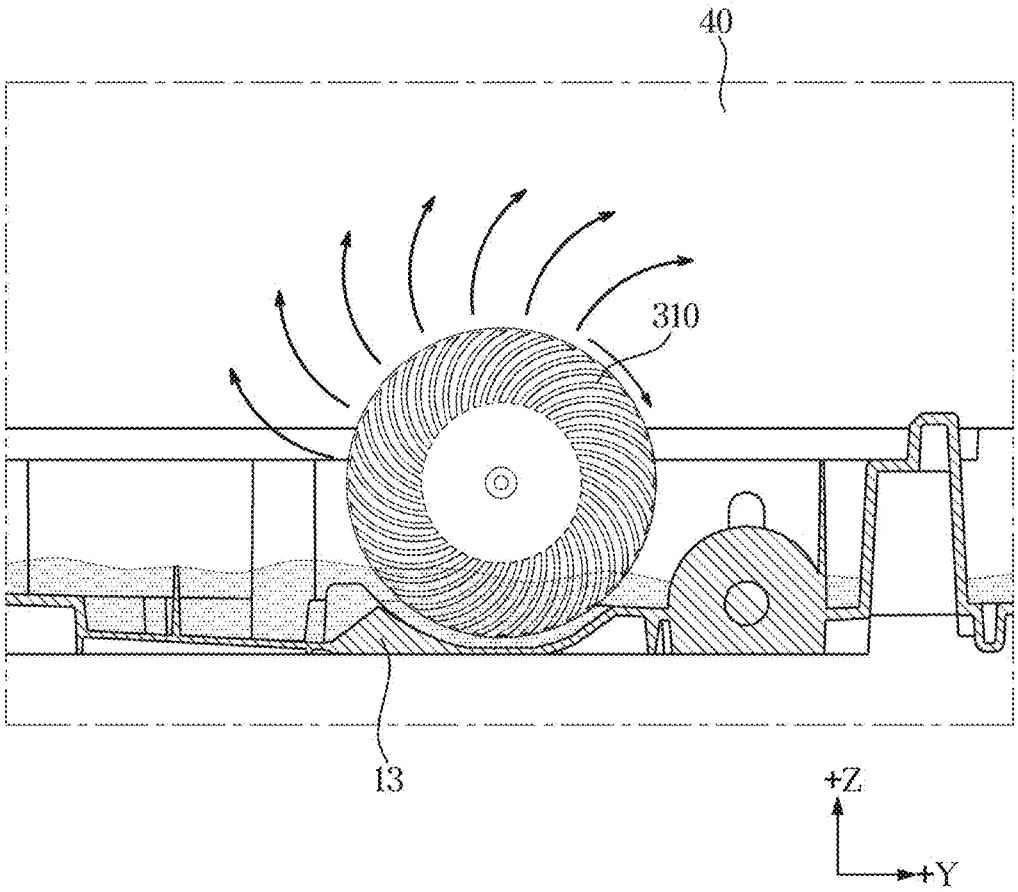
FIG. 11 is a diagram illustrating a state in which a scattering wheel operates in the air conditioner according to various embodiments.
Figure 12:
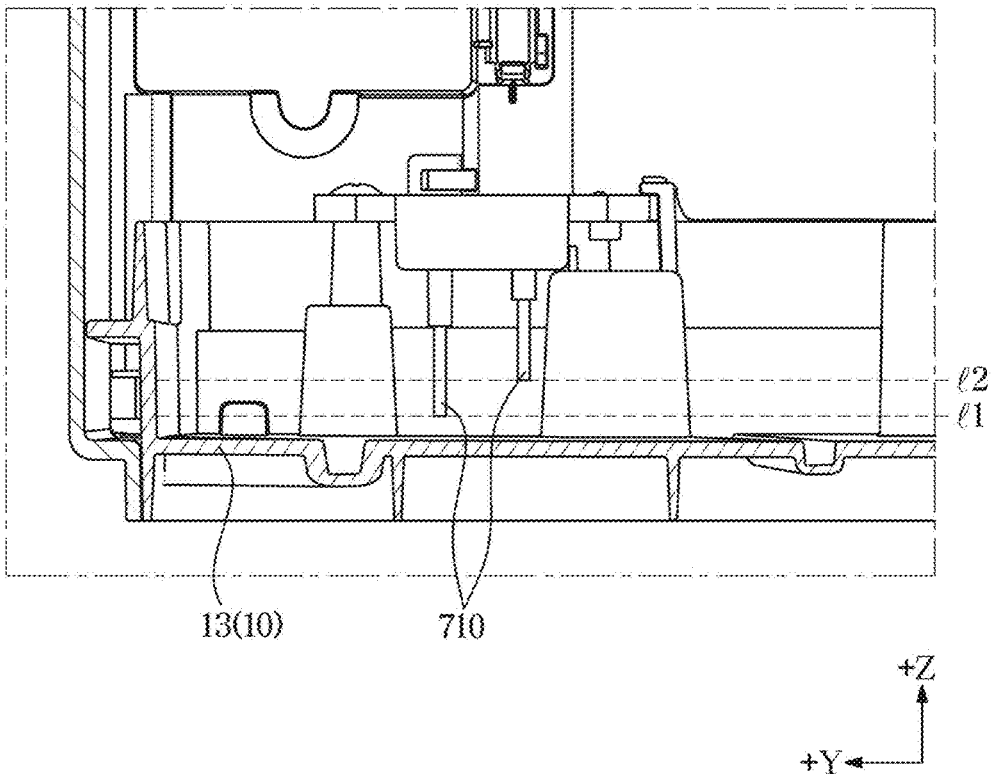
FIG. 12 is a diagram illustrating an enlarged view of various components, such as a water level sensor, of the air conditioner according to various embodiments.

FIG. 10 is a partial perspective view of various components of the air conditioner according to various embodiments, FIG. 11 is a diagram illustrating a state in which a scattering wheel operates in the air conditioner according to various embodiments, and FIG. 12 is diagram illustrating an enlarged view of various components, such as a water level sensor, of the air conditioner according to various embodiments.

The scattering wheel 310 may be provided to be rotatable with respect to the housing 10. For example, the scattering wheel 310 may be provided to be rotatable with respect to the base 13, and may be provided to scatter condensed water collected in the base 13 toward the condenser 40 as the scattering wheel 310 rotates. The condensed water collected in the base 13 may be scattered by a portion of the scattering wheel 310 (refer to FIG. 11) during the process in which the scattering wheel 310 rotates.

The condensed water moved to the condenser 40 may be evaporated by the air flow from the outdoor fan 110. The outdoor fan 110 may evaporate the condensed water, which is moved toward the first heat exchanger 40, by the air flow.

As mentioned above, the air conditioner 3 according to an embodiment of the present disclosure may remove condensed water collected in the base 13 using the scattering wheel 310.

However, the arrangement of the scattering wheel 310 is not limited to the examples shown in FIGS. 10 and 11.

The wheel motor 330 may be configured to generate a driving force for the scattering wheel 310 to rotate. The driving force generated by the wheel motor 330 may be transmitted to the scattering wheel 310 through a rotating shaft 320. The wheel motor 330 may include various types of driving motors that are well-known.

As described above, the air conditioner 3 may include the water level sensor 710.

The water level sensor 710 may be configured to detect various water levels of water stored in the base 13. For example, the water level sensor 710 may detect water at the first water level 11 and the second water level 12 higher than the first water level.

When it is determined that the water level of the water stored in the base 13 is higher than or equal to a predetermined water level according to the detection result of the water level sensor, the wheel motor 330 and the fan motor 120 may be rotated to remove the water in the base 13 and remove foreign substances in the condenser 40.

Hereinbefore the basic process of removing water stored in the base 13 and removing dust from the condenser 40 through the scattering wheel 310 and the outdoor fan 110 is described. Hereinafter each specific operation will be described.

Figure 13:
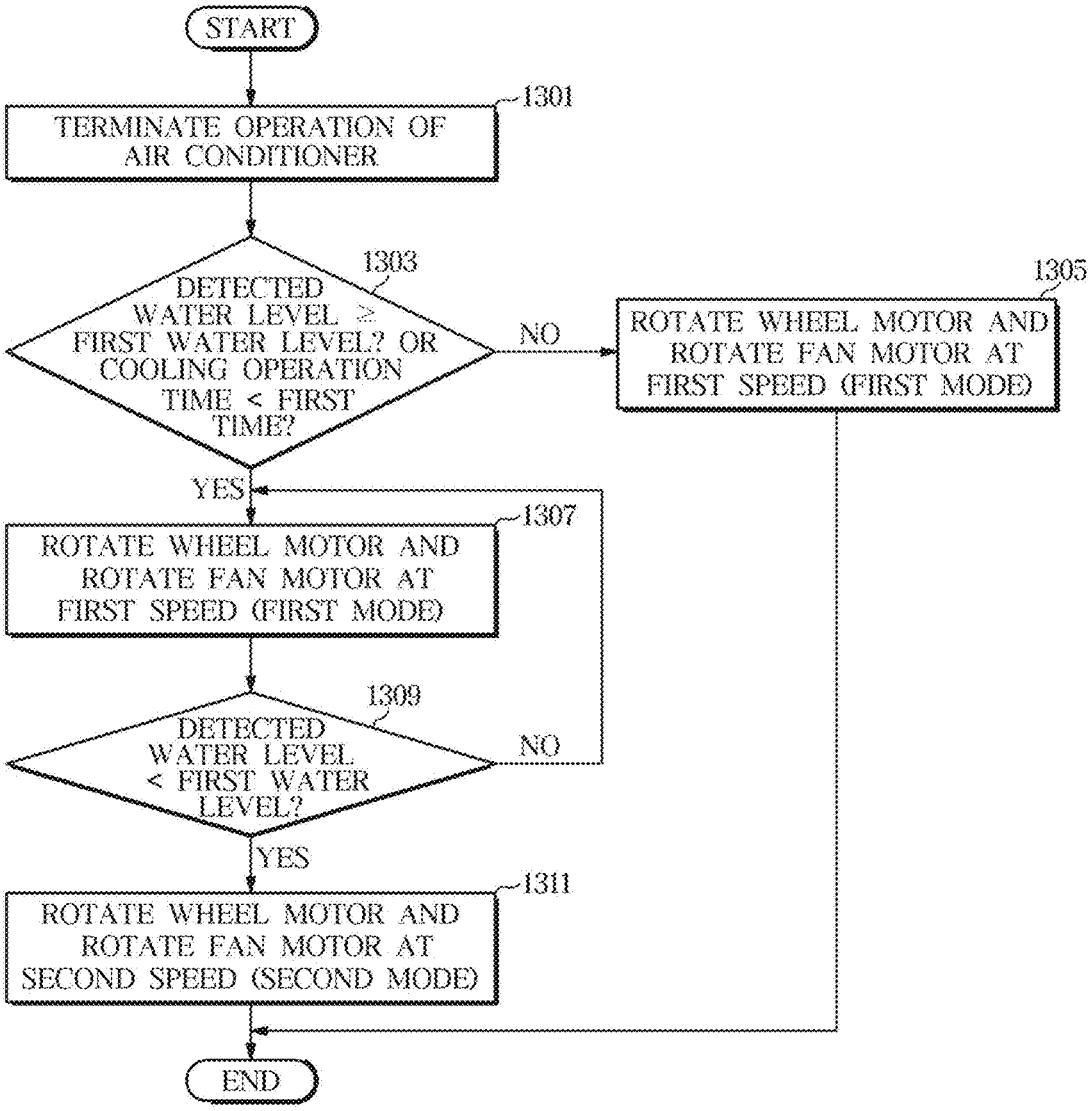
FIG. 13 is a flowchart illustrating example control of a fan motor and a wheel motor based on termination of an operation of the air conditioner, and a water level according to various embodiments.

FIG. 13 is a flowchart illustrating example control of a fan motor and a wheel motor based on termination of an operation of the air conditioner and a water level according to various embodiments.

As described above, the controller may rotate the wheel motor and the fan motor based on the termination of the operation of the air conditioner and the detection result of the water level sensor. This will be described in greater detail below.

In the process of the operation of the air conditioner, water may be stored in the base due to condensed water generated in the evaporator, and when the stored water is not removed in a timely manner, it may cause contamination. Accordingly, in response to the termination of the operation of the air conditioner (1301), the water level sensor may detect the water level stored in the base and rotate the wheel motor and the fan motor according to the detection result, thereby preventing and/or reducing contamination and malfunctions that may occur therefrom.

For example, as the scattering wheel rotates in accordance with the rotation of the wheel motor, the scattering wheel may scatter the water stored in the base to a vicinity of the condenser and evaporate the water so as to remove the water. The water scattered to the condenser may remove foreign substances accumulating in the condenser.

The water level sensor may detect the water level of the water stored in the base, and in response to the detected water level being lower than the first water level (no in 1303), the controller may rotate the wheel motor and rotate the fan motor at a first speed (1305).

In response to a cooling operation time being less than a first time (no in 1303), the controller may rotate the wheel motor and rotate the fan motor at the first speed (1305).

The first time may be set to an appropriate time to remove the stored water and foreign substances, etc., and particularly, the first time may be 10 minutes.

In response to the water level, which is detected by the water level sensor, being higher than or equal to the first water level (yes in 1303), the controller may rotate the wheel motor and rotate the fan motor at the first speed (1307). The first water level may refer, for example, to a height of about 30% of the entire base. A mode of rotating the wheel motor and rotating the fan motor at the first speed may be referred to as a first mode.

The controller may perform the first mode for a reference time. The reference time may be set to an appropriate time for removing the stored water and foreign substances. For example, the reference time may be 10 minutes.

In response to a water level, which is detected after the performance of the first mode, being less than the first water level (yes in 1309), the controller may rotate the wheel motor and rotate the fan motor at a second speed less than the first speed (1311).

A mode of rotating the wheel motor and rotating the fan motor at the second speed may be referred to as a second mode.

The controller may perform the second mode for a reference time. The reference time may be set to an appropriate time for removing the stored water and foreign substances. For example, the reference time may be 10 minutes.

By performing the above-described operations after the termination of the operation of the air conditioner, the stored water, etc. generated during the operation of the air conditioner may be removed to prevent and/or reduce contamination that may occur therefrom, and foreign substances accumulating in the condenser may be removed to prevent and/or reduce contamination and malfunction of the condenser.

Figure 14:
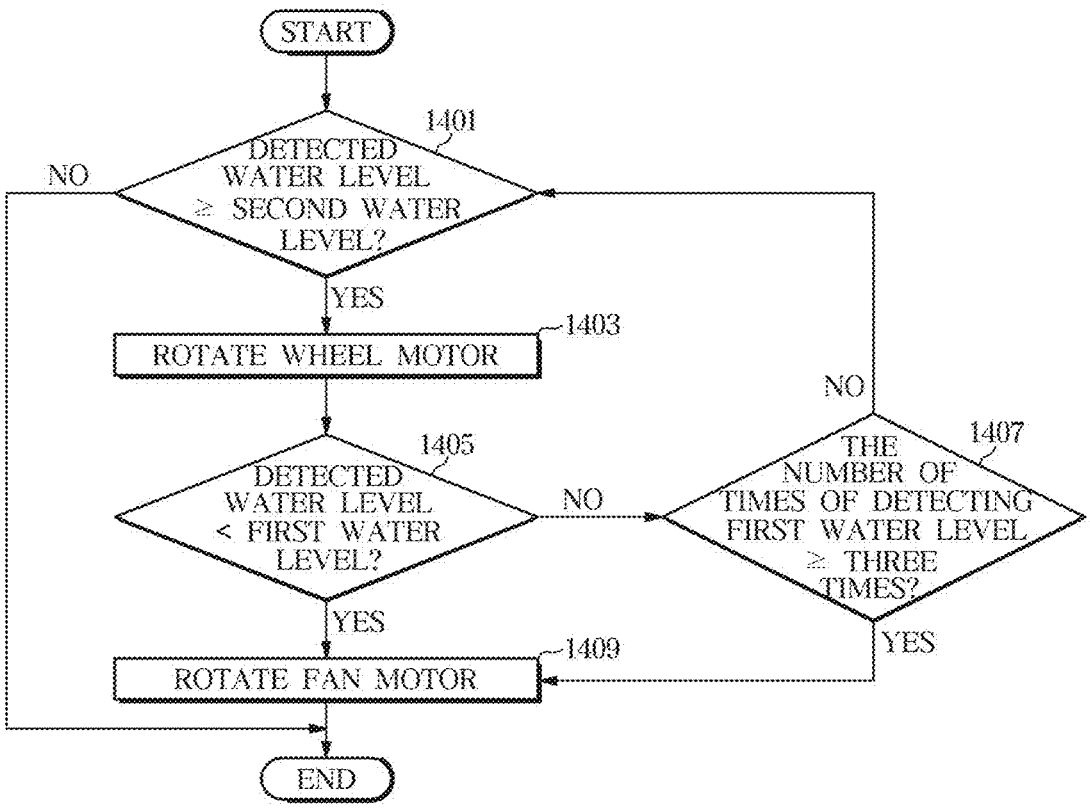
FIG. 14 is a flowchart illustrating example control of the fan motor and the wheel motor when it is determined that water in the base is full due to rain or other reasons according to various embodiments.

FIG. 14 is a flowchart illustrating example control of the fan motor and the wheel motor when it is determined that water in the base is full due to rain or other reasons according to various embodiments.

In response to the water level, which is detected by the water level sensor, being higher than or equal to the second water level higher than the first water level (yes in 1401), the controller may rotate the wheel motor (1403).

The controller may determine that the water level in the base is full in response to the water level, which is detected by the water level sensor, being higher than or equal to the second water level.

In response to a water level, which is detected after the rotation of the wheel motor, being higher than or equal to the first water level (no in 1405), the controller may determine the number of times, in which the first water level is detected, and in response to the number of times, in which the first water level is detected, being greater than or equal to three times (yes in 1407), the controller may maintain the rotation of the fan motor (1409).

This may be determined that the water stored in the base is not sufficiently removed, and thus it is possible to further rotate the wheel motor to scatter the water stored in the base so as to remove the water.

In response to the water level, which is detected after the rotation of the wheel motor, being lower than the first water level (yes in 1405), the controller may rotate the fan motor for a reference time (1409). The reference time may be set to an appropriate time for removing water scattered in the condenser, and the reference time may be about 10 minutes.

When the water in the base is full due to rain or other reasons, the wheel motor and the fan motor may be driven to remove the water and foreign substances in the condenser by the above-mentioned operation.

Figure 15:
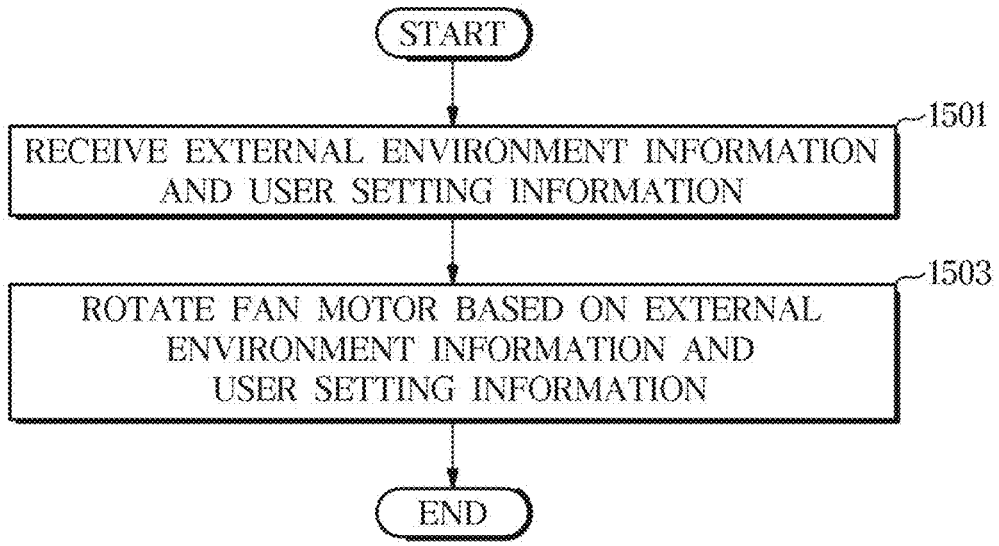
FIG. 15 is a flowchart illustrating example control of the fan motor based on external environment information according to various embodiments.

FIG. 15 is a flowchart illustrating example control of the fan motor based on external environment information according to various embodiments, and FIG. 16 is a table illustrating example control according to various external environment information according to various embodiments.

As described above, the air conditioner may further include the communication circuitry configured to communication with the server.

The communication circuitry may receive various information through communication with the server. For example, the communication circuitry may receive external environment information from the server (1501). In addition, the communication circuitry may receive user setting information (1501). The external environment information may include at least one of outdoor weather information, outdoor temperature information, outdoor humidity information, or outdoor air cleanliness. The user setting information may include various information set by a user to perform cleaning by rotating the fan motor.

The controller may rotate the fan motor based on the external environment information or the user setting information received through the communication circuitry (1503).

Referring to FIG. 16, the controller may perform different controls depending on various external environments received through the communication circuitry.

For example, when the outdoor weather is clear but the outdoor humidity is 60% or higher, different controls may be performed depending on the outdoor air cleanliness. When the cleanliness is good, the fan motor may be turned off. When the cleanliness is normal, the fan motor may be rotated at a first speed for about 10 minutes. When the cleanliness is bad, the fan motor may be rotated at a second speed greater than the first speed for about 15 minutes. Further, when the cleanliness is very bad, the fan motor may be rotated at a maximum speed for about 20 minutes.

Hereinbefore and hereinafter the time for rotating the fan motor is merely an example, and thus the fan motor may be rotated for various times.

When the outdoor air cleanliness is bad, foreign substances may accumulate more easily in the condenser exposed to the outdoor environment. Accordingly, the foreign substances may be removed by rotating the outdoor fan by driving the fan motor.

In addition, when the outdoor weather is clear and the outdoor humidity is less than 60%, and the outdoor air cleanliness is bad, the fan motor may be rotated at the first speed for about 10 minutes. In addition, when the outdoor weather is clear and the outdoor humidity is less than 60%, and the outdoor air cleanliness is very bad, the fan motor may be rotated at the second speed greater than the first speed for about 15 minutes.

When it rains, the rainwater may be stored in the base, and thus the wheel motor may be rotated to additionally rotate the scattering wheel.

For example, when it rains and the outdoor air cleanliness is good or normal, only the fan motor may be rotated at the first speed for about 10 minutes, and when the outdoor air cleanliness is bad or very bad, the fan motor may be rotated at the maximum speed and the wheel motor may be rotated together.

By the above-mentioned operation, it is possible to appropriately remove stored water and foreign substance based on external environmental information.

Figure 17:
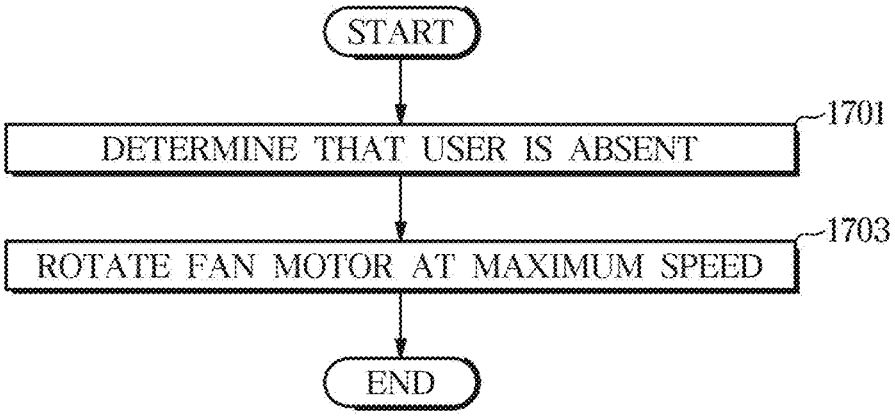
FIG. 17 is a flowchart illustrating example control of the fan motor based on user absence according to various embodiments.

FIG. 17 is a flowchart illustrating example control of the fan motor based on user absence according to various embodiments.

As described above, the air conditioner may further include the communication circuitry configured to communicate with the server, etc.

In response to the determination that a user is absent based on information received through the communication circuitry (1701), the controller may rotate the fan motor at a maximum speed (1703).

By the above-mentioned operation, the absence of the user may be detected and accordingly, the fan motor may be rotated at the maximum speed so as to improve the foreign substance reduction performance of the condenser.

The air conditioner according to an embodiment may include: an evaporator; a condenser, a base disposed under the evaporator, a scattering wheel configured to scatter water stored in the base toward the condenser, a wheel motor configured to rotate the scattering wheel, an outdoor fan configured to blow outdoor air into the condenser, a fan motor configured to rotate the outdoor fan, a water level sensor configured to detect a water level of the water stored in the base, and a controller comprising processing circuitry, individually and/or collectively configured to rotate the wheel motor and the fan motor based on termination of an operation of the air conditioner and a detection result of the water level sensor.

The water stored in the base may be removed to prevent and/or reduce contamination that may occur therefrom.

Further, foreign substances accumulating in the condenser may be removed to prevent and/or reduce contamination and malfunction of the condenser.

In response to the detected water level being higher than or equal to the first water level, the controller may be configured to rotate the wheel motor and to perform a first mode, in which the fan motor is rotated at a first speed, for a reference time.

In response to a water level, detected after the performance of the first mode, being lower than the first water level, the controller may be configured to rotate the wheel motor and to perform a second mode, in which the fan motor is rotated at a second speed less than the first speed, for the reference time.

In response to the detected water level being lower than the first water level, the controller may be configured to rotate the wheel motor and to perform the first mode, in which the fan motor is rotated at the first speed, for the reference time.

In response to the detected water level being higher than or equal to the second water level higher than the first water level, the controller may be configured to rotate the wheel motor.

Based on the water in the base being full due to rain or other reasons, the wheel motor and the fan motor may be driven to remove the water and remove foreign substances in the condenser.

In response to the water level, detected after the rotation of the wheel motor, being lower than the first water level, the controller may be configured to rotate the fan motor for the reference time.

In response to the water level, detected after the rotation of the wheel motor, being higher than or equal to the first water level, the controller may be configured to maintain the rotation of the wheel motor.

The air conditioner may further include the communication circuitry configured to communicate with a server. The controller may be configured to rotate the fan motor based on external environmental information received through the communication circuitry.

It is possible to appropriately remove stored water and foreign substance based on external environmental information.

The external environment information may include at least one of outdoor weather information, outdoor temperature information, outdoor humidity information, or outdoor air cleanliness information.

The air conditioner may further include the communication circuitry configured to communicate with a server. The controller may be configured to rotate the fan motor at a maximum speed in response to determination that a user is absent based on information received through the communication circuitry.

The foreign substance reduction performance of the condenser may be improved by detecting absence of a user and rotating the fan motor at the maximum speed accordingly.

According to an example embodiment, a method of controlling the air conditioner including: an evaporator, a condenser, a base disposed under the evaporator, a scattering wheel configured to scatter water stored in the base toward the condenser, a wheel motor configured to rotate the scattering wheel, an outdoor fan configured to blow outdoor air into the condenser, and a fan motor configured to rotate the outdoor fan, may include: receiving a command to terminate an operation of the air conditioner, detecting a water level of water stored in the base, and rotating the wheel motor and the fan motor based on a detection result.

The rotating of the wheel motor and the fan motor may include, in response to the detected water level being higher than or equal to a first water level, rotating the wheel motor and performing a first mode, in which the fan motor is rotated at a first speed, for a reference time.

The rotating of the wheel motor and the fan motor may include, in response to a water level, detected after the performance of the first mode, being lower than the first water level, rotating the wheel motor and performing a second mode, in which the fan motor is rotated at the second speed less than the first speed, for the reference time.

The rotating of the wheel motor and the fan motor may include, in response to the detected water level being lower than the first water level, rotating the wheel motor and performing the first mode, in which the fan motor is rotated at the first speed, for the reference time.

The rotating of the wheel motor and the fan motor may include, in response to the detected water level higher than or equal to the second water level higher than the first water level, rotating the wheel motor.

The rotating of the wheel motor and the fan motor may include, in response to the water level, detected after the rotation of the wheel motor, being lower than the first water level, rotating the fan motor for the reference time.

The rotating of the wheel motor and the fan motor may include, in response to the water level, detected after the rotation of the wheel motor, being higher than or equal to the first water level, maintaining the rotation of the wheel motor.

The method may further include communicating with the server. The rotating of the wheel motor and the fan motor may include rotating the fan motor based on external environmental information received through communication circuitry.

The external environment information may include at least one of outdoor weather information, outdoor temperature information, outdoor humidity information, or outdoor air cleanliness information.

The method may further include communicating with the server. The rotating of the wheel motor and the fan motor may include rotating the fan motor at the maximum speed in response to determination that a user is absent based on information received through the communication circuitry.

As is apparent from the above description, the water stored in the base may be removed to prevent and/or reduce contamination that may occur therefrom.

Further, foreign substances accumulating in the condenser may be removed to prevent and/or reduce contamination and malfunction of the condenser.

Further, when the water in the base is full due to rain or other reasons, the wheel motor and the fan motor may be driven to remove the water and remove foreign substances in the condenser.

Further, it is possible to appropriately remove stored water and foreign substance based on external environmental information.

Further, the foreign substance reduction performance of the condenser may be improved by detecting the absence of a user and rotating the fan motor at the maximum speed accordingly.

The disclosed embodiments may be embodied in the form of a recording medium storing instructions executable by a computer. The instructions may be stored in the form of program code and, when executed by a processor, may generate a program module to perform the operations of the disclosed embodiments. The recording medium may be embodied as a non-transitory computer-readable recording medium.

The computer-readable recording medium includes all kinds of recording media in which instructions which can be decoded by a computer are stored. For example, there may be a Read Only Memory (ROM), a Random Access Memory (RAM), a magnetic tape, a magnetic disk, a flash memory, and an optical data storage device.

While the present disclosure has been particularly described with reference to various example embodiments, it will be understood that the various example embodiments are intended to be illustrative, not limiting. It will be further understood by those skilled in the art that various changes in form and detail may be made without departing from the spirit and scope of the present disclosure, including the appended claims and their equivalents. It will also be understood that any of the embodiment(s) described herein may be use in conjunction with any other embodiment(s) described herein.

What is claimed is:

1. An air conditioner comprising:

an evaporator;

a condenser;

a base disposed under the evaporator;

a scattering wheel configured to scatter water stored in the base toward the condenser;

a wheel motor configured to rotate the scattering wheel;

an outdoor fan configured to blow outdoor air into the condenser;

a fan motor configured to rotate the outdoor fan;

a water level sensor configured to detect a water level of the water stored in the base; and a controller, comprising processing circuitry, individually and/or collectively, configured to rotate the wheel motor and the fan motor based on termination of an operation of the air conditioner and a detection result of the water level sensor.

2. The air conditioner of claim 1, wherein in response to the detected water level being higher than or equal to a first water level, the controller is configured to rotate the wheel motor and to perform a first mode, in which the fan motor is rotated at a first speed, for a reference time.

3. The air conditioner of claim 2, wherein in response to a water level, detected after the performance of the first mode, being lower than the first water level, the controller is configured to rotate the wheel motor and to perform a second mode, in which the fan motor is rotated at a second speed less than the first speed, for a reference time.

4. The air conditioner of claim 1, wherein in response to the detected water level being lower than a first water level, the controller is configured to rotate the wheel motor and to perform a first mode, in which the fan motor is rotated at a first speed, for a reference time.

5. The air conditioner of claim 1, wherein in response to the detected water level higher than or equal to a second water level higher than a first water level, the controller is configured to rotate the wheel motor.

6. The air conditioner of claim 5, wherein in response to the water level, detected after the rotation of the wheel motor, being lower than the first water level, the controller is configured to rotate the fan motor for a reference time.

7. The air conditioner of claim 5, wherein in response to the water level, detected after the rotation of the wheel motor, being higher than or equal to the first water level, the controller is configured to maintain the rotation of the wheel motor.

8. The air conditioner of claim 1, further comprising:

a communication circuitry configured to communicate with a server, wherein the controller is configured to rotate the fan motor based on external environmental information received through the communication circuitry.

9. The air conditioner of claim 8, wherein the external environment information comprises at least one of outdoor weather information, outdoor temperature information, outdoor humidity information, or outdoor air cleanliness information.

10. The air conditioner of claim 1, further comprising:

a communication circuitry configured to communicate with a server, wherein the controller is configured to rotate the fan motor at a maximum speed in response to determination that a user is absent based on information received through the communication circuitry.

11. A method of controlling an air conditioner comprising an evaporator; a condenser; a base disposed under the evaporator; a scattering wheel configured to scatter water stored in the base toward the condenser; a wheel motor configured to rotate the scattering wheel; an outdoor fan configured to blow outdoor air into the condenser; and a fan motor configured to rotate the outdoor fan, the method comprising:

receiving a command to terminate an operation of the air conditioner;

detecting a water level of water stored in the base; and rotating the wheel motor and the fan motor based on a detection result.

12. The control method of the air conditioner of claim 11, wherein the rotating of the wheel motor and the fan motor comprises, in response to the detected water level being higher than or equal to a first water level, rotating the wheel motor and performing a first mode, in which the fan motor is rotated at a first speed, for a reference time.

13. The control method of the air conditioner of claim 12, wherein the rotating of the wheel motor and the fan motor comprises, in response to a water level, detected after the performance of the first mode, being lower than the first water level, rotating the wheel motor and performing a second mode, in which the fan motor is rotated at a second speed less than the first speed, for a reference time.

14. The control method of the air conditioner of claim 11, wherein the rotating of the wheel motor and the fan motor comprises, in response to the detected water level being lower than a first water level, rotating the wheel motor and performing a first mode, in which the fan motor is rotated at a first speed, for a reference time.

15. The control method of the air conditioner of claim 11, wherein the rotating of the wheel motor and the fan motor comprises, in response to the detected water level higher than or equal to a second water level higher than a first water level, rotating the wheel motor.

* * * * *